US011239540B2

(12) United States Patent
Meng

(10) Patent No.: US 11,239,540 B2
(45) Date of Patent: Feb. 1, 2022

(54) IRREGULAR-SHAPED TRIPLE-MODE CAVITY RESONANCE STRUCTURE AND FILTER WITH THE RESONANCE STRUCTURE

(71) Applicant: HONGKONG FINGU DEVELOPMENT COMPANY LIMITED, Hong Kong (CN)

(72) Inventor: Qingnan Meng, Hubei (CN)

(73) Assignee: HONGKONG FINGU DEVELOPMENT COMPANY LIMITED, Hong Kong (CN)

( * ) Notice: Subject to any disclaimer, the term of this patent is extended or adjusted under 35 U.S.C. 154(b) by 0 days.

(21) Appl. No.: 17/270,458

(22) PCT Filed: Dec. 29, 2018

(86) PCT No.: PCT/CN2018/125168
§ 371 (c)(1),
(2) Date: Feb. 23, 2021

(87) PCT Pub. No.: WO2020/073529
PCT Pub. Date: Apr. 16, 2020

(65) Prior Publication Data

US 2021/0249750 A1 Aug. 12, 2021

(30) Foreign Application Priority Data

Oct. 10, 2018 (CN) ..... 201811179912.4

(51) Int. Cl.
*H01P 7/10* (2006.01)
*H01P 7/06* (2006.01)
(Continued)

(52) U.S. Cl.
CPC ..... *H01P 7/06* (2013.01); *H01P 1/207* (2013.01); *H01P 1/2086* (2013.01); *H01P 7/105* (2013.01)

(58) Field of Classification Search
CPC ..... H01P 7/105; H01P 7/10; H01P 1/2084; H01P 1/2086; H01P 1/20; H01P 1/2002;
(Continued)

(56) References Cited

FOREIGN PATENT DOCUMENTS

CN 1269914 A 10/2000
CN 1472842 A 2/2004
(Continued)

*Primary Examiner* — Stephen E. Jones
(74) *Attorney, Agent, or Firm* — Gang Yu

(57) ABSTRACT

The disclosure discloses an irregular-shaped cavity multi-mode resonance structure and a filter with the resonance structure. The irregular-shaped cavity multi-mode resonance structure includes a cavity and a cover plate, wherein the cavity is internally provided with a dielectric resonance block and a dielectric support frame; at least one end face of the cavity is concave or convex, and at least one end face of the dielectric resonance block is convex or concave, the dielectric resonance block and the dielectric support frame form a triple-mode dielectric resonance rod; one end or any end of the cube-like dielectric resonance block is respectively connected with the dielectric support frame; the dielectric support frame is connected with an inner wall of the cavity; and the dielectric resonance block forms triple-mode resonance in three directions along the X, Y and Z axes of the cavity.

44 Claims, 2 Drawing Sheets

(51) Int. Cl.
*H01P 1/207* (2006.01)
*H01P 1/208* (2006.01)

(58) Field of Classification Search
CPC ..... H01P 1/201; H01P 1/207; H01P 1/208; H01P 1/2082
See application file for complete search history.

(56) References Cited

FOREIGN PATENT DOCUMENTS

| | | | |
|---|---|---|---|
| CN | 202363563 | U | 8/2012 |
| CN | 205985280 | U | 2/2017 |
| CN | 109346806 | A | 2/2019 |
| JP | H10224113 | A | 8/1998 |
| JP | 2005223665 | A | 8/2005 |
| KR | 100783860 | B1 | 12/2007 |

IRREGULAR-SHAPED TRIPLE-MODE CAVITY RESONANCE STRUCTURE AND FILTER WITH THE RESONANCE STRUCTURE

CROSS-REFERENCE TO RELATED APPLICATION(S)

The present invention is a national stage application of International Patent Application No. PCT/CN2018/125168, which is filed on Dec. 29, 2018 and claims priority to Chinese Patent Priority No. 201811179912.4, filed to the National Intellectual Property Administration, PRC on Oct. 10, 2018, entitled "Irregular-shaped Triple-mode Cavity Resonance Structure and Filter with the Resonance Structure", the disclosure of which is hereby incorporated by reference in its entirety.

TECHNICAL FIELD

The disclosure relates to a base station filter, an antenna feeder filter, a combiner, an anti-interference filter and the like used in the field of wireless communications. Types of the filters may be band pass, band stop, high pass and low pass, and the disclosure particularly relates to an irregular-shaped triple-mode cavity resonance structure and a filter with the irregular-shaped triple-mode cavity resonance structure.

BACKGROUND

Along with the rapid development of 4G mobile communications to 5G mobile communications, miniaturization and high performance of communication facilities are increasingly highly required. Traditional filters are gradually replaced by single-mode dielectric filters due to large metallic cavity volume and ordinary performance, the single-mode dielectric filters mainly include a Transverse Electric 01 (TE01)-mode dielectric filter and a Transverse Magnetic (TM)-mode dielectric filter, the TE01-mode dielectric filter and the TM-mode dielectric filter generally adopt a single-mode dielectric resonance mode, and the resonance mode increases a certain Q value, but has defects of high manufacturing cost and large volume.

In order to solve technical problems of high cost and large volume of the single-mode dielectric filters, a triple-mode dielectric filter emerges at the right moment. In an art known to inventors, the triple-dielectric filter generally includes a TE triple-mode filter and a TM triple-mode filter. The TE triple-mode filter has the characteristics of being complex in coupling mode, large in volume and high in Q value, and the TM triple-mode filter has the characteristics of being simple in coupling mode, small in volume and low in Q value. With respect to a TE triple-mode filter and a TM triple-mode filter of a same frequency band, the weight, cost and volume of the TM triple-mode filter are greatly smaller than those of the TE triple-mode filter. Therefore, in the art known to inventors, the TE triple-mode filter is generally adopted to design a narrow band filter, and the TM triple-mode filter is generally used as other types of filters. Since a dielectric resonance block of the TM triple-mode filter is coated by baked silver, a vitreous substance is formed between a silver layer after silver baking and a surface of the dielectric resonance block, thus actual conductivity is greatly degraded, the Q value is actually low, and the use range of the TM triple-mode filter is further limited. Therefore, how to obtain a TM triple-mode filter of a small volume and a high Q value is a new direction of research and development of filters.

The TM triple-mode filter known to inventors generally adopts a structure that a cube/cube-like/spherical dielectric resonance block is arranged in a cube/cube-like/spherical resonance cavity, the dielectric resonance block is supported by a dielectric base, and a ratio of a size of a single side of the resonance cavity to a size of a single side of the dielectric resonance block is generally greater than 1.6. When the volume of the resonance cavity is maintained and the volume of the dielectric resonance block is slightly increased, or the volume of the resonance cavity is slightly decreased and the volume of the dielectric resonance block is maintained, or the volume of the resonance cavity is slightly decreased and the volume of the dielectric resonance block is slightly increased, comparison of data provided by Table 1 shows that while the ratio of the size of the single side of the resonance cavity to the size of the single side of the dielectric resonance block is increased, a Q value of a base mode is increased along with increase of the ratio, a Q value of a higher-order mode is decreased along with increase of the ratio, the size of the dielectric resonance block is decreased along with increase of the ratio, the size of a cavity is continuously increased, when the size is approximate to a ¾ wavelength size of the cavity, the size of the dielectric resonance block is continuously decreased, the Q value of the base mode is also decreased, and a frequency of the higher-order mode is approximate to or far away from a frequency of the base mode along with increase of the ratio at times.

Cavity volumes of the resonance cavities corresponding to different ratios are also different and can be selected according to actual demands. Single cavities with a ratio of 1.6 or greater may be selected for cavities of different sizes in a ratio range in Table 1 and corresponding cube resonators when the performance requirement of filters is higher. Therefore, when the ratio of the size of the single side of the resonance cavity to the size of the single side of the dielectric resonance block is greater than 1.6, the Q value is proportional to a distance between the resonance cavity and the dielectric resonance block, but a defect that the volume of a filter is too large is caused.

The patent with the Application No. 2018101455572 discloses a triple-mode cavity structure with a small volume and a high Q value, and the structure ensures that the volume of a filter is effectively decreased and a Q value is increased while an outer surface of a dielectric resonance block and an inner surface of a cavity are arranged in parallel and the distance between the two surfaces is very small. However, such structure has the following technical problems: 1. Due to the very small distance between the dielectric resonance block and an inner wall of the cavity, the tuning range of a tuning screw is limited, and installation and debugging of the dielectric resonance block are obstructed; 2. Due to the very small distance between the dielectric resonance block and the inner wall of the cavity, the distance between the dielectric resonance block and the single cavity is very sensitive to a single cavity resonance frequency, and thus on-batch production of the dielectric resonance block is obstructed; and 3. Since the very small distance between the dielectric resonance block and the inner wall of the cavity is very sensitive to the single cavity resonance frequency, the design precision of the dielectric resonance block and the cavity is highly required, and thus the processing and manufacturing cost is increased.

TABLE 1

| Single-cavity side length mm | Side length of dielectric resonance block | Q value | Ratio (single-cavity side length/ side length of dielectric resonance block) | Higher-order frequency | Dielectric constant and frequency |
|---|---|---|---|---|---|
| 48 | 23.4 | 30562 | 2.05 | 2327.00 | ER = 35, F:1880 |
| 46 | 23.54 | 28770 | 1.95 | 2315.00 | ER = 35, F:1880 |
| 44 | 23.75 | 26683 | 1.85 | 2295.00 | ER = 35, F:1880 |
| 42 | 24.04 | 24308 | 1.75 | 2264.00 | ER = 35, F:1880 |
| 40 | 24.4 | 21686 | 1.64 | 2224.00 | ER = 35, F:1880 |
| 38 | 24.9 | 18783 | 1.53 | 2172.00 | ER = 35, F:1880 |
| 36 | 25.7 | 15496 | 1.40 | 2081.00 | ER = 35, F:1880 |

SUMMARY

In light of the defects of an art known to inventors, the technical problem to be solved by the disclosure is to provide an irregular-shaped triple-mode cavity resonance structure and a filter with the irregular-shaped triple-mode cavity resonance structure, reduce the overall insertion loss of the filter to meet requirements of the cavity filter on a smaller insert and a smaller size.

The disclosure discloses an irregular-shaped triple-mode cavity resonance structure, including a cavity and a cover plate, wherein the cavity is internally provided with a dielectric resonance block and a dielectric support frame, wherein the cavity is of a cube-like shape, at least one end face of the cavity is concave, the dielectric resonance block is of a cube-like shape, at least one end face of the dielectric resonance block is convex, the dielectric support frame is respectively connected with the dielectric resonance block and an inner wall of the cavity, the dielectric resonance block and the dielectric support frame form a triple-mode dielectric resonance rod, and a dielectric constant of the dielectric support frame is smaller than a dielectric constant of the dielectric resonance block; a ratio K of a size of a single side of the inner wall of the cavity to a size of a corresponding single side of the dielectric resonance block meets: transition point 1≤K≤transition point 2, a Q value of a higher-order mode, adjacent to a base mode, of the triple-mode dielectric resonance structure is transited into a Q value of the base mode of the triple-mode dielectric resonance structure, a base mode resonance frequency after transition is equal to a base mode resonance frequency prior to transition, a Q value of the base mode after transition is greater than a Q value of the base mode prior to transition, and a Q value of the higher-order mode, adjacent to the base mode, after transition is smaller than a Q value of the higher-order mode, adjacent to the base mode, prior to transition; the triple-mode dielectric resonance structure is internally provided with a coupling structure for changing an orthogonal property of a degenerate triple-mode electromagnetic field in the cavity; and the triple-mode dielectric resonance structure is internally provided with a frequency tuning device for changing a resonance frequency of the degenerate triple-mode in the cavity.

The disclosure further discloses an irregular-shaped triple-mode cavity resonance structure, including a cavity and a cover plate, wherein the cavity is internally provided with a dielectric resonance block and a dielectric support frame, wherein the cavity is of a cube-like shape, at least one end face of the cavity is convex, the dielectric resonance block is of a cube-like shape, at least one end face of the dielectric resonance block is concave, the dielectric support frame is respectively connected with the dielectric resonance block and an inner wall of the cavity, the dielectric resonance block and the dielectric support frame form a triple-mode dielectric resonance rod, and a dielectric constant of the dielectric support frame is smaller than a dielectric constant of the dielectric resonance block; a ratio K of a size of a single side of the inner wall of the cavity to a size of a corresponding single side of the dielectric resonance block meets: transition point 1≤K≤transition point 2, a Q value of a higher-order mode, adjacent to a base mode, of the triple-mode dielectric resonance structure is transited into a Q value of the base mode of the triple-mode dielectric resonance structure, a base mode resonance frequency after transition is equal to a base mode resonance frequency prior to transition, a Q value of the base mode after transition is greater than a Q value of the base mode prior to transition, and a Q value of the higher-order mode, adjacent to the base mode, after transition is smaller than a Q value of the higher-order mode, adjacent to the base mode, prior to transition; the triple-mode dielectric resonance structure is internally provided with a coupling structure for changing an orthogonal property of a degenerate triple-mode electromagnetic field in the cavity; and the triple-mode dielectric resonance structure is internally provided with a frequency tuning device for changing a resonance frequency of the degenerate triple-mode in the cavity.

In some embodiments of the disclosure, the dielectric resonance block is of a solid structure or a hollow structure; and a hollow part of the dielectric resonance block of the hollow structure is filled with air or a nested dielectric resonance block, and a volume of the nested dielectric resonance block is smaller than or equal to a volume of a hollow chamber.

In some embodiments of the disclosure, the nested dielectric resonance block is of a cube-like shape, and at least one end face of the nested dielectric resonance block is concave or convex.

In some embodiments of the disclosure, a film medium is arranged on at least one end face of the nested dielectric resonance block In some embodiments of the disclosure, a film medium is arranged on at least one end face of the cavity or/and at least one end face of the dielectric resonance block.

In some embodiments of the disclosure, a film medium is arranged on the convex end face of the cavity or/and the concave end face of the dielectric resonance block.

In some embodiments of the disclosure, a value of the transition point 1 and a value of the transition point 2 both vary according to different base mode resonance frequencies of the dielectric resonance block, the dielectric constant of the dielectric resonance block and the dielectric constant of the support frame.

In some embodiments of the disclosure, when the base mode resonance frequency of the dielectric resonance block after transition remains unchanged, the Q value of the triple-mode dielectric resonance structure is related to the K value, the dielectric constant of the dielectric resonance block and the size of the dielectric resonance block.

In some embodiments of the disclosure, when the K value is increased to a maximum from 1.0, the K value has three Q value transition points within a variation range, and each Q value transition point enables the Q value of the base mode of the K value and the Q value of the higher-order mode, adjacent to the base mode, of the K value to be transited; when the Q value of the higher-order mode, adjacent to the base mode, is transited into the Q value of the base mode, the Q value after transition is increased compared with the Q value prior to transition.

In some embodiments of the disclosure, in four areas formed by a starting point and a final point of the K value and the three Q value transition points, the Q value of the base mode and the Q value of the higher-order mode, adjacent to the base mode, vary along variation of cavity sizes and dielectric resonance rod block sizes, and different areas have different requirements when being applied to a filter.

In some embodiments of the disclosure, 1.03≤the value of transition point 1≤1.30, 1.03≤the value of transition point 2≤1.30, and the value of transition point 1<the value of transition point 2.

In some embodiments of the disclosure, the coupling structure is provided on the dielectric resonance block, and the coupling structure at least includes two non-parallel holes and/or grooves and/or cut corners and/or chamfers.

In some embodiments of the disclosure, the grooves or the cut corners or the chamfers are provided at edges of the dielectric resonance block.

In some embodiments of the disclosure, the holes or the grooves are provided in end faces of the dielectric resonance block, wherein center lines of the holes or grooves are parallel to edges perpendicular to the end faces with holes or grooves of the dielectric resonance block;

In some embodiments of the disclosure, the coupling structure is provided in the cavity, and the coupling structure at least includes two non-parallel chamfers and/or bosses provided at inner corners of the cavity and/or tapping lines/pieces, out of contact with the dielectric resonance block, provided in the cavity.

In some embodiments of the disclosure, the frequency tuning device includes a tuning screw/disc provided on the cavity and/or a film provided on a surface of the dielectric resonance block and/or a film provided on an inner wall of the cavity and/or a film provided on an inner wall of the cover plate.

In some embodiments of the disclosure, at least one end face of the dielectric resonance block is provided with at least one dielectric support frame.

The disclosure further discloses a filter having the irregular-shaped triple-mode cavity resonance structure, the filter includes a cavity, a cover plate and an input/output structure, wherein the cavity is internally provided with at least one irregular-shaped triple-mode cavity resonance structure.

In some embodiments of the disclosure, the irregular-shaped triple-mode cavity resonance structure is combined with a single-mode resonance structure, a dual-mode resonance structure and a triple-mode resonance structure in different modes to form filters of different volumes; a coupling of any two resonance cavities formed by permutation and combination by the irregular-shaped triple-mode cavity resonance structure and any one of a single-mode resonance cavity, a dual-mode resonance cavity and a triple-mode resonance cavity, resonance rods in the two resonance cavities are parallel, and the coupling is achieved through a size of a window between the two resonance cavities, the size of the window is determined according to coupling amounts; and the filter has function properties of band pass, band stop, high pass, low pass and a duplexer, a multiplexer and a combiner formed among the band pass, the band stop, the high pass and the low pass.

In some embodiments of the disclosure, on premise that the resonance frequency of the triple-mode cavity resonance structure with the irregular-shaped cavity remains unchanged, Q value of the triple-mode is related to the ratio K of a side length of the inner wall of the cavity to a side length of the dielectric resonance block, the dielectric constant of the dielectric resonance block and a size change range of the dielectric block; and a range of K value is related to different resonance frequencies and dielectric constants of the dielectric resonance rod and the support frame.

In the above technical scheme, for the change range of the ratio K of the size of the side length of the inner wall of the cavity of the triple-mode cavity resonance structure with the irregular-shaped cavity to the size of the dielectric resonance block, when K value is increased from 1.0 to the maximum, the K value has three transition points within a variation range, each transition point enables the Q value of the base mode and the Q value of the higher-order mode adjacent to the base mode to be transited; and when the Q value of the higher-order mode, adjacent to the base mode, is transited into the Q value of the base mode, the Q value after transition is increased compared with the Q value prior to transition.

Further, in four areas formed by a starting point and a final point of the K value and the three Q value transition points, the Q value of the base mode and adjacent Q of the higher-order mode gradually, vary along with variation of cavity sizes and dielectric resonance rod block sizes, and different areas have different requirements when being applied to a filter (the application of different areas is added to the specification and embodiments).

Further, the dielectric resonance block of the disclosure is of a solid structure of a cube-like shape, wherein the definition of the cube-like shape is that the dielectric resonance block is a cuboid or a cube, when the dielectric resonance block has a same size in X, Y and Z axes, a degenerate triple mode is formed, and the degenerate triple mode is coupled with other single cavities to form a pass-band filter; and when differences of sizes in three directions, along the X, Y and Z axes, are slightly unequal, orthogonal-like triple-mode resonance is formed, if the orthogonal-like triple-mode is capable of coupling with other cavities into a pass-band filter, the sizes are acceptable, and if the orthogonal-like triple-mode is not capable of coupling with other cavities into the pass-band filter, the sizes are unacceptable; and when the differences of the sizes in the three directions along the X, Y and Z axes are greatly different, the degenerate triple-mode or the orthogonal-like triple-mode can not be formed, three modes of different frequencies are formed instead, thus the modes can not be coupled with other cavities into the pass-band filter, and the sizes are unacceptable.

Further, the triple-mode cavity resonance structure with the irregular-shaped cavity is at least provided with two non-parallel coupling devices for changing the orthogonal property of the degenerate triple-mode electromagnetic field in the cavity, each of the coupling devices includes cut corners and/or holes provided beside edges of the dielectric resonance block, or includes chamfers/cut corners provided beside edges of the cavity, or cut corners and/or holes provided beside edges of the dielectric resonance block and chamfers/cut corners provided beside edges of the cavity, or includes tapping line/pieces provided on non-parallel planes in the cavity, wherein the cut corners are of a triangular-prism shape, a cuboid shape or a sector shape, and the holes are of a circle shape, a rectangle shape or a polygon shape. After corner cutting or hole forming, under the condition of holding the frequency, a side length of the dielectric resonance block is increased, and the Q value is slightly decreased; depths of the cut corners or holes are of through or partial cut corners/partial hole structures according to the required coupling amounts; the coupling amounts are affected by sizes of the cut corners/chamfers/holes; the coupling tuning structure includes a coupling screw disposed in a direction perpendicular or parallel to the cut corner and/or a direction parallel to the hole, the coupling screw is made of a metal, or the coupling screw is made of a metal and the metal surface is electroplated by copper or electroplated by silver, or the coupling screw is made of a medium, or the coupling screw is made of a surface metalized medium; and the shape of the coupling screw is any one of metallic rods, medium rods, metallic discs, medium discs, metallic rods with metallic discs, metallic rods with medium discs, medium discs with metallic discs and medium rods with medium discs.

Further, the triple-mode cavity resonance structure with the irregular-shaped cavity forms the degenerate triple-mode in directions along the X, Y and Z axes, a resonance frequency of the degenerate triple-mode in an X-axis direction is achieved by additionally installing a tuning screw or a tuning disc at a place with concentrated field intensity on one or two faces, corresponding to the cavity, of the X-axis so as to change a distance or change capacitance; a resonance frequency in a Y-axis direction is achieved by additionally installing a tuning screw or a tuning disc at a place with concentrated field intensity on one or two faces, corresponding to the cavity, of the Y-axis so as to change a distance or change capacitance; and a resonance frequency in a Z-axis direction is achieved by additionally installing a tuning screw rod or a tuning disc at a place with concentrated field intensity on one or two faces, corresponding to the cavity, of the Z-axis so as to change a distance or change capacitance; dielectric constant films of different shapes and thicknesses are adhered to a surface of the dielectric resonance block, an inner wall of the cavity, an inner wall of the cover plate or a bottom of the tuning screw, the dielectric constant films are made of a ceramic medium or a ferroelectric material, the frequency can be adjust by changing the dielectric constant; the tuning screw or the tuning disc is made of a metal, or the tuning screw or the tuning disc is made of a metal and the metal surface is electroplated by copper or electroplated by silver, or the tuning screw or the tuning disc is made of a medium, or the tuning screw or the tuning disc is made of a surface metalized medium; and the shape of the tuning screw is any one of metallic rods, medium rods, metallic discs, medium discs, metallic rods with metallic discs, metallic rods with medium discs, medium discs with metallic discs and medium rods with medium discs; a frequency temperature coefficient of the cube-like dielectric resonance block is controlled by adjusting proportions of medium materials, and is compensated according to frequency deviation variation of a filter at different temperatures; and when the dielectric support frame and the inner wall of the cavity are fixed, in order to avoid stress generated by the cavity and the dielectric material in a sudden temperature change circumstance, an elastic body is used between the dielectric support frame and the inner wall of the cavity for transition, so as to buffer the reliability risk caused by an expansion coefficient of the material.

Further, the triple-mode cavity resonance structure with the irregular-shaped cavity is composed of the cavity, the dielectric resonance block and the support frame; when the cavity is of the cube-like shape, the single cube-like dielectric resonance block and the dielectric support frame are installed in any one axial direction of the cavity, and a center of the dielectric resonance block coincides with or approaches to a center of the cavity. The air-similar dielectric support frame supports with any one single face of the cube-like dielectric block, or supports with six faces, or supports with different combinations of two different faces, three faces, four faces and five faces, a face without the support frame is an air face, the air face is arbitrarily combined with the dielectric support frame; a number of the dielectric support frame on each face is one or more, or the dielectric support frame on each face is a complex dielectric constant support frame composed of multiple layers of different dielectric constant medium materials, single-layer and multi-layer medium material support frames are arbitrarily combined with a cube-like medium block, one or more dielectric support frames is installed on different faces according to demands, on faces with the dielectric support frames, to hold the triple-mode frequencies and the Q value, the size, corresponding to the axial direction of the dielectric resonance block, of the dielectric support frame is slightly decreased; a single face support combination is any one face for supporting the dielectric resonance block, especially a bottom face in a vertical direction or a bearing face; a two faces support combination includes parallel faces such as upper and lower faces, front and rear faces and left and right faces, and also includes nonparallel faces such as upper and front faces, upper and rear faces, upper and left faces and upper and right faces; a three faces support combination includes three faces perpendicular to one another, or two parallel faces and one nonparallel face; a four faces support combination includes two pairs of parallel faces or a pair of parallel faces and two another nonparallel faces; a support combination of five faces includes support structures on other faces except any one face of a front face/a rear face/a left face/a right face/an upper face/a lower face; and a support combination of six faces includes support structures on all faces of a front face/a rear face/a left face/a right face/an upper face/a lower face.

Further, any end of the cube-like dielectric resonance block is connected with the dielectric support frame in a mode of crimping, adhesion or sintering; for a one-face connection or a different-face-combination connection, multilayer medium support frames are fixed in a mode of adhesion, sintering, or crimping, and the dielectric support frame and the inner wall of the cavity are connected in a fixation mode of adhesion, crimping, welding, sintering, screw, etc; and a radio frequency channel formed by coupling of radio frequency signals in directions of X, Y and Z axes of the triple mode causes loss and generates heat, the dielectric resonance block is sufficiently connected with the inner wall of the cavity through the dielectric support frame, and thus the heat is conducted into the cavity for heat dissipation.

Further, the cube-like dielectric resonance block has a single dielectric constant or composite dielectric constants; the composite dielectric constant is formed by two or more materials of different dielectric constants, for a dielectric resonance block with a composite dielectric constant, the materials of different dielectric constants are combined up and down, left and right, asymmetrically or in a nested mode, when the materials of different dielectric constants are nested in the dielectric resonance block, one or more layers of materials of different dielectric constants are nested, the dielectric resonance block with the composite dielectric constants needs to comply with variation rules of the Q value transition points. When the dielectric resonance block is subjected to cut side coupling among triple modes, to hold a required frequency, corresponding side lengths of two faces adjacent to the cut sides are parallelly adjusted. The dielectric resonance block is made of a ceramic or medium material; and medium sheets of different thicknesses and different dielectric constants are added on a surface of the dielectric resonance block.

Further, the dielectric constant of the dielectric support frame is similar to an air dielectric constant, or the dielectric constant of the dielectric support frame is greater than an air dielectric constant and smaller than the dielectric constant of the dielectric resonance block, a surface area of the dielectric support frame is smaller than or equal to a surface area of the cube-like dielectric resonance block, and the dielectric support frame is of a cylinder shape, a cube shape, a cuboid shape, etc. The dielectric support frame is of a solid structure or a hollow structure, and the dielectric support frame of the hollow structure has a single hole or multiple holes, each hole takes a shape of a circle, a square, a polygon and an arc; and the dielectric support frame is made of air, plastics, ceramics or mediums; the dielectric support frame is connected with the dielectric resonance block, and when the dielectric constant of the dielectric support frame is similar to the air dielectric constant, the dielectric support frame has no influence on the resonance frequency of the triple-mode; when the dielectric constant of the dielectric support frame is greater than air dielectric constant but smaller than the dielectric constant of the dielectric resonance block, in order to maintain the original triple-mode frequency, the size, corresponding to an axial direction of the dielectric resonance block, of the dielectric support frame is slightly decreased; and a support frame with a dielectric constant similar to the air dielectric constant and a support frame with a dielectric constant greater than the air dielectric constant but smaller than the dielectric constant of the dielectric resonance block can be provided on different directions and different corresponding faces of the dielectric resonance block in combination, and when the two above support frames with different dielectric constants are used in combination, the size, corresponding to the axial direction of the dielectric resonance block, of the support frame with the dielectric constant greater than the air dielectric constant is slightly decreased on the basis of an original size.

Further, the cavity is of a cube-like shape, and in order to achieve coupling among three modes, on premise that a size of the cube-like dielectric resonance block is not changed, cut sides for achieving coupling of the three modes are processed on any two adjacent faces of the cavity, sizes of the cut sides are relevant to required coupling amounts; and a coupling of two of the three modes is achieved through the cut sides of the cube-like, and other coupling is achieved through cut corners of two adjacent sides of the cavity, walls are not broken when corners of the adjacent sides of the cavity are cut, and corner-cut faces need to be completely sealed with the cavity. The cavity is made of a metal or non-metal material, a surface of the metal or the non-metal material is electroplated by copper or electroplated by silver, and when the cavity is made of the non-metal material, the inner wall of the cavity is electroplated by a conductive material, for example, silver or copper, that is, a plastic or composite material is electroplated by copper or electroplated by silver.

Further, the irregular-shaped triple-mode cavity resonance structure is combined with a single-mode resonance structure, a dual-mode resonance structure and a triple-mode resonance structure in different modes to form filters of different volumes; a coupling of any two resonance cavities formed by permutation and combination by the irregular-shaped triple-mode cavity resonance structure and any one of a single-mode resonance cavity, a dual-mode resonance cavity and a triple-mode resonance cavity, resonance rods in the two resonance cavities are parallel, and the coupling is achieved through a size of a window between the two resonance cavities, the size of the window is determined according to coupling amounts; and the filter has function properties of band pass, band stop, high pass, low pass and a duplexer, a multiplexer and a combiner formed among the band pass, the band stop, the high pass and the low pass.

The dielectric constant of the cube-like dielectric resonance block of the disclosure is greater than the dielectric constant of the support frame, when the ratio of a size of a single side of the inner wall of the cavity to a size of a single side of the dielectric resonance block ranges from 1.03 to 1.30, the Q value of the higher-order mode is transited into the Q value of the base mode, the Q value of the base mode of the triple-mode dielectric is increased, the Q value of the higher-order mode is decreased, compared with a single-mode dielectric filter and a triple-mode dielectric filter known to inventors with same volumes and frequencies, the Q value is increased by 30% or above, and according to the combination of the triple-mode structure and different types of single cavities, for example, the combination of the triple-mode structure and a single mode cavity, the combination of a triple-mode and a TM mode, and the combination of a triple-mode and a TE single mode, the more the triple-mode structures are used in the filter, the smaller the filter size and the insertion loss are; and the triple-mode cavity resonance structure with the irregular-shaped cavity can generate triple-mode resonance in the X-axis, Y-axis and Z-axis directions, when generating triple-mode resonance in the X-axis, Y-axis and Z-axis directions.

When the ratio of the side length of the inner wall of the cavity to the corresponding side length of the dielectric resonance block is 1.0 to Q value transition point 1, the cavity is of a pure dielectric Q value when the ratio is 1.0, the Q value is continuously increased on the basis of the pure dielectric Q value when the size of the cavity is increased, the Q value of the higher-order mode is greater than the Q value of the base mode, and the original Q value of the higher-order mode is approximate to a new Q value of the base mode when the ratio is increased to transition point 1.

After entering transition point 1, in case of maintaining the resonance frequency of the base mode unchanged, the Q value of the base mode is greater than the Q value of the higher-order mode. Along with the increase of the ratio, as the sizes of the dielectric block and the cavity are both increased, the Q value of the base mode is also increased, the Q value of the higher-order mode is also increased, when the ratio approaches the Q value transition point 2, the Q value of the base mode reaches the highest, and between the Q value transition point 1 of the base mode and the Q value transition point 2 of the base mode, the frequency of the higher-order mode is far away from and close to the frequency of the base mode along with the change of the ratio of the cavity to the dielectric resonance block from transition point 1 to transition point 2.

After entering the transition point 2, the Q value of the base mode is smaller than the Q value of the higher-order mode, along with the increase of the ratio, the size of the dielectric resonance block is decreased, the size of the cavity is increased, and the Q value of the base mode is increased continuously, and when the ratio approaches the transition point 3, the Q value of the base mode approaches the Q value of the transition point 2.

After the ratio enters the transition point 3, the Q value of the base mode is increased along with the increase of the ratio, the Q value of the higher-order mode is decreased along with the increase of the ratio, the size of the dielectric resonance block is decreased along with the increase of the ratio, the size of the cavity is continuously increased, and when the size is close to ¾ of a wavelength size of the cavity, as the size of the dielectric resonance block is decreased continuously, the Q value of the base mode is decreased accordingly, and the frequency of the higher-order mode is far away from and close to the frequency of the base mode along with the increase of the ratio. A specific ratio of the transition point is related to the dielectric constant and the frequency of the dielectric resonance block and whether the dielectric resonance block has a single or composite dielectric constant.

The side length of the inner wall of the cavity and the side length of the dielectric resonance block may be equal or not in three directions, along the X, Y and Z axes. The cavity and the cube-like dielectric resonance block may form triple-mode when having equal sizes in the X-axis, the Y-axis and the Z-axis; size differences in three directions, along the X, Y and Z axes may also be slightly unequal, when the size of the single side of the cavity and the size of the corresponding single side of the dielectric resonance block in one of the X-axis, Y-axis and Z-axis directions is different from the sizes of the single sides in the other two directions, or any one of the sizes of symmetrical single sides of the cavity and the dielectric resonance block is different from the sizes of the single sides in the other two directions, the frequency of one of the three modes changes to be different from the frequencies of the other two modes, the greater the size difference is, the greater the difference between the frequencies of one mode of the three modes and the other two modes is, when the size in one direction is greater than the sizes in the other two directions, the frequency is decreased on the original basis, and when the size in one direction is smaller than the sizes in the other two directions, the frequency may be increased on the original basis, and triple-mode may gradually changes into a dual-mode or a single-mode; when difference among the three axial sizes of the cavity and the resonance block is too large, and when the sizes of the symmetrical single sides in three directions, along the X, Y and Z axes, are different, the frequencies of the three modes are different, under the condition that the side length sizes in the three directions are greatly different, the base mode is a single mode, and under the condition that the side length sizes in the three directions are not greatly different, the frequency difference is not large, and although the frequencies may change, a triple-mode state may still be maintained by the tuning device.

Coupling among the three modes may be achieved by providing at least two non-parallel coupling devices, for changing the orthogonal property of the electromagnetic field of the degenerate triple-mode in the cavity, in the triple-mode cavity resonance structure with the irregular-shaped cavity, the coupling device includes cut corners and/or holes provided beside the edges of the dielectric resonance block, or includes chamfers/cut corners provided beside edges of the cavity, or includes cut corners and/or holes provided beside the edges of the dielectric resonance block and chamfers/cut corners provided beside the edges of the cavity, or includes tapping lines/pieces provided on non-parallel planes in the cavity, the cut corners are of a triangular-prism shape, a cuboid shape or a sector shape, and the holes are of a circle shape, a rectangle shape or a polygon shape. After corner cutting or hole forming, in case of frequency maintenance, side lengths of the dielectric resonance block are increased, and the Q value is slightly decreased. Depths of the cut corners or holes are of through or partial cut corners/partial hole structures according to required coupling amounts, and the coupling amounts are affected by the sizes of the cut corners/chamfers/holes. A coupling screw is arranged on a coupling tuning structure in a direction perpendicular or parallel to the cut corners and/or a direction parallel to the holes; the coupling screw is made of a metal, or the coupling screw is made of a metal and the metal is electroplated by copper or electroplated by silver, or the coupling screw is made of a medium, or the coupling screw is made of a surface metallized medium; the coupling screw takes a shape of any one of metallic rods, medium rods, metallic discs, medium discs, metallic rods with metallic discs, metallic rods with medium discs, medium rods with metallic discs and medium rods with medium discs.

The resonance frequency of the three modes in the X-axis direction is achieved by additionally installing the tuning screw or the tuning disc at the place with concentrated field intensity on one or two faces of the cavity corresponding to the X axis so as to change the distance or change capacitance; the resonance frequency in the Y-axis direction is achieved by additionally installing the tuning screw or the tuning disc at the place with concentrated field intensity on one or two faces of the Y axis corresponding to the cavity so as to change the distance or change the capacitance; and the resonance frequency in the Z-axis direction is achieved by additionally installing the tuning screw or the tuning disc at the place with concentrated field intensity on one or two faces of the Z axis corresponding to the cavity so as to change the distance or change the capacitance.

The triple-mode structure with Q value transition of the dielectric resonant is arbitrarily arranged and combined with the single-mode resonance structure, the dual-mode resonance structure and the triple-mode resonance structure in different modes to form required filters of different sizes; the filter has function properties of band pass, band stop, high pass, low pass and the duplexer, the multiplexer formed among the band pass, the band stop, the high pass and the low pass; and coupling of any two resonance cavities formed by permutation and combination of the single-mode resonance structure, the dual-mode resonance structure and the triple-mode resonance structure is achieved through the size of the window between the two resonance cavities when resonance rods in two resonance structures are parallel.

Some embodiments of the disclosure have the beneficial effects that the structure is simple in structure and convenient to use; by setting the ratio of the size of the single side of the inner wall of a metallic cavity of a dielectric triple mode to the size of the single side of the dielectric resonance block within 1.01-1.30, the resonance rod is matched with the cavity to form the triple-mode structure while reverse turning of specific parameters is achieved, and thus a high Q value is ensured when the resonance rod and the cavity are at a small distance apart. Furthermore, some embodiments disclose a filter with the irregular-shaped triple-mode cavity resonance structure, and compared with a triple-mode filter known to inventors, the filter has insertion loss reduced by 30% or greater on premise of same frequencies and same volumes. Dielectric resonant frequency transition triple-mode structures formed by the cube-like dielectric resonance block, the dielectric support frame and the cover plate of the cavity of the disclosure have magnetic fields orthogonal to and perpendicular to one another in directions of the X, Y and Z axes, thus three non-interfering resonance modes are formed, a higher-order mode frequency is transited into a high Q value base-mode frequency, coupling is formed among three magnetic fields, and different bandwidth demands of the filters are met by adjusting coupling intensity. When two filters with the irregular-shaped triple-mode cavity resonance structure are used in a typical 1800 MHz frequency filter, a volume equivalent to six single cavities of an original cavity is achieved, the volume may be reduced by 40% on the basis of an original cavity filter, and the insertion loss may also be reduced by about 30%. Since the volume is greatly reduced, and the processing time and electroplating areas are correspondingly reduced, the cost is still equivalent to the cost of the cavity although the dielectric resonance block is used, if the material cost of the dielectric resonance block is greatly reduced, the design may have obvious cost advantages, when the filter has multiple cavities, three triple-mode structure may be used, and volume and performance may be obviously improved. Furthermore, on premise that the Q value of a single cavity is not greatly decreased, on the basis of the triple-mode resonance structure, a structure of the dielectric resonance block and/or cavity is changed (at least one irregular-shaped end face is provided), so that the tuning range of the tuning screw is increased, meanwhile, the sensitivity to resonance frequencies is reduced due to the small distance between the cavity and the dielectric resonance block, thereby facilitating production debugging and reducing production cost.

Figure 1:
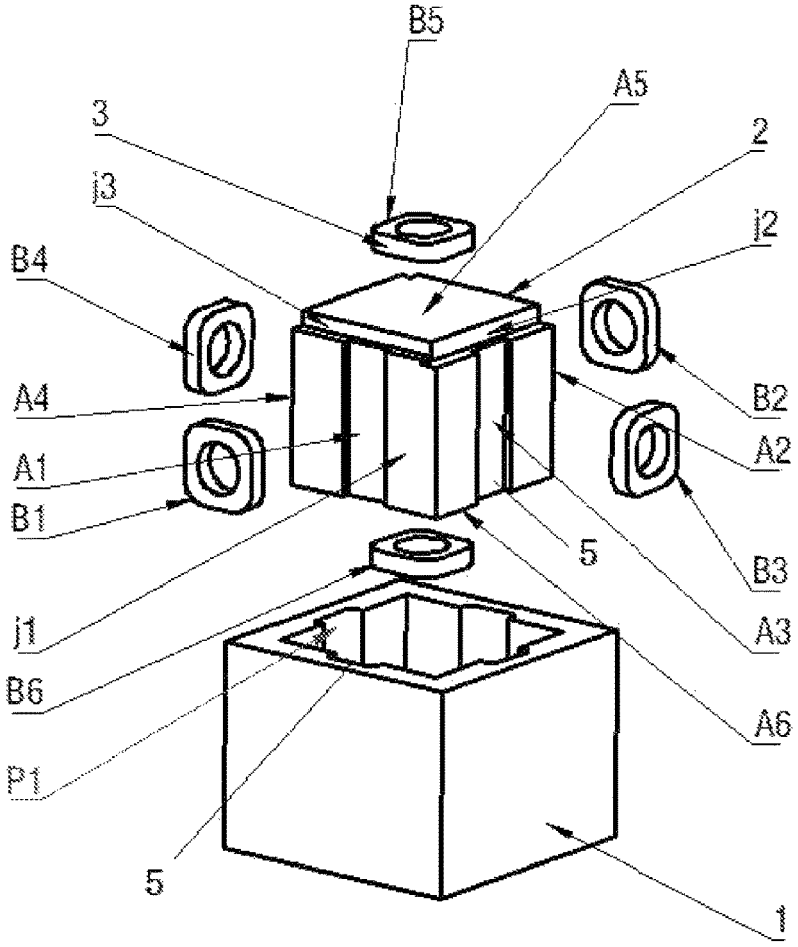
FIG. 1 shows a structural schematic diagram of an irregular-shaped triple-mode cavity resonance structure of an embodiment of the disclosure; wherein a dielectric resonance block is concave, a cavity is convex.

In the figures: 1: cavity, 2: dielectric resonance block, 3: dielectric support frame, 5: groove, B1: first dielectric support frame, B2: second dielectric support frame, B3: third dielectric support frame, B4: fourth dielectric support frame, B5: fifth dielectric support frame, B6: sixth dielectric support frame.

DETAILED DESCRIPTION OF THE EMBODIMENTS

The disclosure discloses an irregular-shaped triple-mode cavity resonance structure, including a cavity and a cover plate, wherein the cavity is internally provided with a dielectric resonance block and a dielectric support frame, wherein the cavity is of a cube-like shape, at least one end face of the cavity is concave, the dielectric resonance block is of a cube-like shape, at least one end face of the dielectric resonance block is convex, the dielectric support frame is respectively connected with the dielectric resonance block and an inner wall of the cavity, the dielectric resonance block and the dielectric support frame form a triple-mode dielectric resonance rod, and a dielectric constant of the dielectric support frame is smaller than a dielectric constant of the dielectric resonance block; a ratio K of a size of a single side of the inner wall of the cavity to a size of a corresponding single side of the dielectric resonance block meets: transition point 1≤K≤transition point 2, a Q value of a higher-order mode, adjacent to a base mode, of the triple-mode dielectric resonance structure is transited into a Q value of the base mode of the triple-mode dielectric resonance structure, a base mode resonance frequency after transition is equal to a base mode resonance frequency prior to transition, a Q value of the base mode after transition is greater than a Q value of the base mode prior to transition, and a Q value of the higher-order mode, adjacent to the base mode, after transition is smaller than a Q value of the higher-order mode, adjacent to the base mode, prior to transition; the triple-mode dielectric resonance structure is internally provided with a coupling structure for changing an orthogonal property of a degenerate triple-mode electromagnetic field in the cavity; and the triple-mode dielectric resonance structure is internally provided with a frequency tuning device for changing a resonance frequency of the degenerate triple-mode in the cavity.

The disclosure further discloses an irregular-shaped triple-mode cavity resonance structure, including a cavity and a cover plate, wherein the cavity is internally provided with a dielectric resonance block and a dielectric support frame, wherein the cavity is of a cube-like shape, at least one end face of the cavity is convex, the dielectric resonance block is of a cube-like shape, at least one end face of the dielectric resonance block is concave, the dielectric support frame is respectively connected with the dielectric resonance block and an inner wall of the cavity, the dielectric resonance block and the dielectric support frame form a triple-mode dielectric resonance rod, and a dielectric constant of the dielectric support frame is smaller than a dielectric constant of the dielectric resonance block; a ratio K of a size of a single side of the inner wall of the cavity to a size of a corresponding single side of the dielectric resonance block meets: transition point 1≤K≤transition point 2, a Q value of a higher-order mode, adjacent to a base mode, of the triple-mode dielectric resonance structure is transited into a Q value of the base mode of the triple-mode dielectric resonance structure, a base mode resonance frequency after transition is equal to a base mode resonance frequency prior to transition, a Q value of the base mode after transition is greater than a Q value of the base mode prior to transition, and a Q value of the higher-order mode, adjacent to the base mode, after transition is smaller than a Q value of the higher-order mode, adjacent to the base mode, prior to transition; the triple-mode dielectric resonance structure is internally provided with a coupling structure for changing an orthogonal property of a degenerate triple-mode electromagnetic field in the cavity; and the triple-mode dielectric resonance structure is internally provided with a frequency tuning device for changing a resonance frequency of the degenerate triple-mode in the cavity.

In some embodiments of the disclosure, the dielectric resonance block is of a solid structure or a hollow structure; and a hollow part of the dielectric resonance block of the hollow structure is filled with air or a nested dielectric resonance block, and a volume of the nested dielectric resonance block is smaller than or equal to a volume of a hollow chamber.

In some embodiments of the disclosure, the nested dielectric resonance block is of a cube-like shape, and at least one end face of the nested dielectric resonance block is concave or convex.

In some embodiments of the disclosure, a film medium is arranged on at least one end face of the nested dielectric resonance block In some embodiments of the disclosure, a film medium is arranged on at least one end face of the cavity or/and at least one end face of the dielectric resonance block.

In some embodiments of the disclosure, a film medium is arranged on the convex end face of the cavity or/and the concave end face of the dielectric resonance block.

In some embodiments of the disclosure, a value of the transition point 1 and a value of the transition point 2 both vary according to different base mode resonance frequencies of the dielectric resonance block, the dielectric constant of the dielectric resonance block and the dielectric constant of the support frame.

In some embodiments of the disclosure, when the base mode resonance frequency of the dielectric resonance block after transition remains unchanged, the Q value of the triple-mode dielectric resonance structure is related to the K value, the dielectric constant of the dielectric resonance block and the size of the dielectric resonance block.

In some embodiments of the disclosure, when the K value is increased to a maximum from 1.0, the K value has three Q value transition points within a variation range, and each Q value transition point enables the Q value of the base mode of the K value and the Q value of the higher-order mode, adjacent to the base mode, of the K value to be transited; when the Q value of the higher-order mode, adjacent to the base mode, is transited into the Q value of the base mode, the Q value after transition is increased compared with the Q value prior to transition.

In some embodiments of the disclosure, in four areas formed by a starting point and a final point of the K value and the three Q value transition points, the Q value of the base mode and the Q value of the higher-order mode, adjacent to the base mode, vary along variation of cavity sizes and dielectric resonance rod block sizes, and different areas have different requirements when being applied to a filter.

In some embodiments of the disclosure, 1.03≤the value of transition point 1≤1.30, 1.03≤the value of transition point 2≤1.30, and the value of transition point 1<the value of transition point 2.

In some embodiments of the disclosure, the coupling structure is provided on the dielectric resonance block, and the coupling structure at least includes two non-parallel holes and/or grooves and/or cut corners and/or chamfers.

In some embodiments of the disclosure, the grooves or the cut corners or the chamfers are provided at edges of the dielectric resonance block.

In some embodiments of the disclosure, the holes or the grooves are provided in end faces of the dielectric resonance block, wherein center lines of the holes or grooves are parallel to edges perpendicular to the end faces with holes or grooves of the dielectric resonance block;

In some embodiments of the disclosure, the coupling structure is provided in the cavity, and the coupling structure at least includes two non-parallel chamfers and/or bosses provided at inner corners of the cavity and/or tapping lines/pieces, out of contact with the dielectric resonance block, provided in the cavity.

In some embodiments of the disclosure, the frequency tuning device includes a tuning screw/disc provided on the cavity and/or a film provided on a surface of the dielectric resonance block and/or a film provided on an inner wall of the cavity and/or a film provided on an inner wall of the cover plate.

In some embodiments of the disclosure, at least one end face of the dielectric resonance block is provided with at least one dielectric support frame.

The disclosure further discloses a filter having the irregular-shaped triple-mode cavity resonance structure, the filter includes a cavity, a cover plate and an input/output structure, wherein the cavity is internally provided with at least one irregular-shaped triple-mode cavity resonance structure.

In some embodiments of the disclosure, the irregular-shaped triple-mode cavity resonance structure is combined with a single-mode resonance structure, a dual-mode resonance structure and a triple-mode resonance structure in different modes to form filters of different volumes; a coupling of any two resonance cavities formed by permutation and combination by the irregular-shaped triple-mode cavity resonance structure and any one of a single-mode resonance cavity, a dual-mode resonance cavity and a triple-mode resonance cavity, resonance rods in the two resonance cavities are parallel, and the coupling is achieved through a size of a window between the two resonance cavities, the size of the window is determined according to coupling amounts; and the filter has function properties of band pass, band stop, high pass, low pass and a duplexer, a multiplexer and a combiner formed among the band pass, the band stop, the high pass and the low pass.

In some embodiments of the disclosure, on premise that the resonance frequency of the triple-mode cavity resonance structure with the irregular-shaped cavity remains unchanged, Q value of the triple-mode is related to the ratio K of a side length of the inner wall of the cavity to a side length of the dielectric resonance block, the dielectric constant of the dielectric resonance block and a size change range of the dielectric block; and a range of K value is related to different resonance frequencies and dielectric constants of the dielectric resonance rod and the support frame.

In the above technical scheme, for the change range of the ratio K of the size of the side length of the inner wall of the cavity of the triple-mode cavity resonance structure with the irregular-shaped cavity to the size of the dielectric resonance block, when K value is increased from 1.0 to the maximum, the K value has three transition points within a variation range, each transition point enables the Q value of the base mode and the Q value of the higher-order mode adjacent to the base mode to be transited; and when the Q value of the higher-order mode, adjacent to the base mode, is transited into the Q value of the base mode, the Q value after transition is increased compared with the Q value prior to transition.

Further, in four areas formed by a starting point and a final point of the K value and the three Q value transition points, the Q value of the base mode and adjacent Q of the higher-order mode gradually, vary along with variation of cavity sizes and dielectric resonance rod block sizes, and different areas have different requirements when being applied to a filter (the application of different areas is added to the specification and embodiments).

Further, the dielectric resonance block of the disclosure is of a solid structure of a cube-like shape, wherein the definition of the cube-like shape is that the dielectric resonance block is a cuboid or a cube, when the dielectric resonance block has a same size in X, Y and Z axes, a degenerate triple mode is formed, and the degenerate triple mode is coupled with other single cavities to form a pass-band filter; and when differences of sizes in three directions, along the X, Y and Z axes, are slightly unequal, orthogonal-like triple-mode resonance is formed, if the orthogonal-like triple-mode is capable of coupling with other cavities into a pass-band filter, the sizes are acceptable, and if the orthogonal-like triple-mode is not capable of coupling with other cavities into the pass-band filter, the sizes are unacceptable; and when the differences of the sizes in the three directions along the X, Y and Z axes are greatly different, the degenerate triple-mode or the orthogonal-like triple-mode can not be formed, three modes of different frequencies are formed instead, thus the modes can not be coupled with other cavities into the pass-band filter, and the sizes are unacceptable Further, the triple-mode cavity resonance structure with the irregular-shaped cavity is at least provided with two non-parallel coupling devices for changing the orthogonal property of the degenerate triple-mode electromagnetic field in the cavity, each of the coupling devices includes cut corners and/or holes provided beside edges of the dielectric resonance block, or includes chamfers/cut corners provided beside edges of the cavity, or cut corners and/or holes provided beside edges of the dielectric resonance block and chamfers/cut corners provided beside edges of the cavity, or includes tapping line/pieces provided on non-parallel planes in the cavity, wherein the cut corners are of a triangular-prism shape, a cuboid shape or a sector shape, and the holes are of a circle shape, a rectangle shape or a polygon shape. After corner cutting or hole forming, under the condition of holding the frequency, a side length of the dielectric resonance block is increased, and the Q value is slightly decreased; depths of the cut corners or holes are of through or partial cut corners/partial hole structures according to the required coupling amounts; the coupling amounts are affected by sizes of the cut corners/chamfers/holes; the coupling tuning structure includes a coupling screw disposed in a direction perpendicular or parallel to the cut corner and/or a direction parallel to the hole, the coupling screw is made of a metal, or the coupling screw is made of a metal and the metal surface is electroplated by copper or electroplated by silver, or the coupling screw is made of a medium, or the coupling screw is made of a surface metalized medium; and the shape of the coupling screw is any one of metallic rods, medium rods, metallic discs, medium discs, metallic rods with metallic discs, metallic rods with medium discs, medium discs with metallic discs and medium rods with medium discs.

Further, the triple-mode cavity resonance structure with the irregular-shaped cavity forms the degenerate triple-mode in directions along the X, Y and Z axes, a resonance frequency of the degenerate triple-mode in an X-axis direction is achieved by additionally installing a tuning screw or a tuning disc at a place with concentrated field intensity on one or two faces, corresponding to the cavity, of the X-axis so as to change a distance or change capacitance; a resonance frequency in a Y-axis direction is achieved by additionally installing a tuning screw or a tuning disc at a place with concentrated field intensity on one or two faces, corresponding to the cavity, of the Y-axis so as to change a distance or change capacitance; and a resonance frequency in a Z-axis direction is achieved by additionally installing a tuning screw rod or a tuning disc at a place with concentrated field intensity on one or two faces, corresponding to the cavity, of the Z-axis so as to change a distance or change capacitance; dielectric constant films of different shapes and thicknesses are adhered to a surface of the dielectric resonance block, an inner wall of the cavity, an inner wall of the cover plate or a bottom of the tuning screw, the dielectric constant films are made of a ceramic medium or a ferroelectric material, the frequency can be adjust by changing the dielectric constant; the tuning screw or the tuning disc is made of a metal, or the tuning screw or the tuning disc is made of a metal and the metal surface is electroplated by copper or electroplated by silver, or the tuning screw or the tuning disc is made of a medium, or the tuning screw or the tuning disc is made of a surface metalized medium; and the shape of the tuning screw is any one of metallic rods, medium rods, metallic discs, medium discs, metallic rods with metallic discs, metallic rods with medium discs, medium discs with metallic discs and medium rods with medium discs; a frequency temperature coefficient of the cube-like dielectric resonance block is controlled by adjusting proportions of medium materials, and is compensated according to frequency deviation variation of a filter at different temperatures; and when the dielectric support frame and the inner wall of the cavity are fixed, in order to avoid stress generated by the cavity and the dielectric material in a sudden temperature change circumstance, an elastic body is used between the dielectric support frame and the inner wall of the cavity for transition, so as to buffer the reliability risk caused by an expansion coefficient of the material.

Further, the triple-mode cavity resonance structure with the irregular-shaped cavity is composed of the cavity, the dielectric resonance block and the support frame; when the cavity is of the cube-like shape, the single cube-like dielectric resonance block and the dielectric support frame are installed in any one axial direction of the cavity, and a center of the dielectric resonance block coincides with or approaches to a center of the cavity. The air-similar dielectric support frame supports with any one single face of the cube-like dielectric block, or supports with six faces, or supports with different combinations of two different faces, three faces, four faces and five faces, a face without the support frame is an air face, the air face is arbitrarily combined with the dielectric support frame; a number of the dielectric support frame on each face is one or more, or the dielectric support frame on each face is a complex dielectric constant support frame composed of multiple layers of different dielectric constant medium materials, single-layer and multi-layer medium material support frames are arbitrarily combined with a cube-like medium block, one or more dielectric support frames is installed on different faces according to demands, on faces with the dielectric support frames, to hold the triple-mode frequencies and the Q value, the size, corresponding to the axial direction of the dielectric resonance block, of the dielectric support frame is slightly decreased; a single face support combination is any one face for supporting the dielectric resonance block, especially a bottom face in a vertical direction or a bearing face; a two faces support combination includes parallel faces such as upper and lower faces, front and rear faces and left and right faces, and also includes nonparallel faces such as upper and front faces, upper and rear faces, upper and left faces and upper and right faces; a three faces support combination includes three faces perpendicular to one another, or two parallel faces and one nonparallel face; a four faces support combination includes two pairs of parallel faces or a pair of parallel faces and two another nonparallel faces; a support combination of five faces includes support structures on other faces except any one face of a front face/a rear face/a left face/a right face/an upper face/a lower face; and a support combination of six faces includes support structures on all faces of a front face/a rear face/a left face/a right face/an upper face/a lower face.

Further, any end of the cube-like dielectric resonance block is connected with the dielectric support frame in a mode of crimping, adhesion or sintering; for a one-face connection or a different-face-combination connection, multilayer medium support frames are fixed in a mode of adhesion, sintering, or crimping, and the dielectric support frame and the inner wall of the cavity are connected in a fixation mode of adhesion, crimping, welding, sintering, screw, etc; and a radio frequency channel formed by coupling of radio frequency signals in directions of X, Y and Z axes of the triple mode causes loss and generates heat, the dielectric resonance block is sufficiently connected with the inner wall of the cavity through the dielectric support frame, and thus the heat is conducted into the cavity for heat dissipation.

Further, the cube-like dielectric resonance block has a single dielectric constant or composite dielectric constants; the composite dielectric constant is formed by two or more materials of different dielectric constants, for a dielectric resonance block with a composite dielectric constant, the materials of different dielectric constants are combined up and down, left and right, asymmetrically or in a nested mode, when the materials of different dielectric constants are nested in the dielectric resonance block, one or more layers of materials of different dielectric constants are nested, the dielectric resonance block with the composite dielectric constants needs to comply with variation rules of the Q value transition points. When the dielectric resonance block is subjected to cut side coupling among triple modes, to hold a required frequency, corresponding side lengths of two faces adjacent to the cut sides are parallelly adjusted. The dielectric resonance block is made of a ceramic or medium material; and medium sheets of different thicknesses and different dielectric constants are added on a surface of the dielectric resonance block.

Further, the dielectric constant of the dielectric support frame is similar to an air dielectric constant, or the dielectric constant of the dielectric support frame is greater than an air dielectric constant and smaller than the dielectric constant of the dielectric resonance block, a surface area of the dielectric support frame is smaller than or equal to a surface area of the cube-like dielectric resonance block, and the dielectric support frame is of a cylinder shape, a cube shape, a cuboid shape, etc. The dielectric support frame is of a solid structure or a hollow structure, and the dielectric support frame of the hollow structure has a single hole or multiple holes, each hole takes a shape of a circle, a square, a polygon and an arc; and the dielectric support frame is made of air, plastics, ceramics or mediums; the dielectric support frame is connected with the dielectric resonance block, and when the dielectric constant of the dielectric support frame is similar to the air dielectric constant, the dielectric support frame has no influence on the resonance frequency of the triple-mode; when the dielectric constant of the dielectric support frame is greater than air dielectric constant but smaller than the dielectric constant of the dielectric resonance block, in order to maintain the original triple-mode frequency, the size, corresponding to an axial direction of the dielectric resonance block, of the dielectric support frame is slightly decreased; and a support frame with a dielectric constant similar to the air dielectric constant and a support frame with a dielectric constant greater than the air dielectric constant but smaller than the dielectric constant of the dielectric resonance block can be provided on different directions and different corresponding faces of the dielectric resonance block in combination, and when the two above support frames with different dielectric constants are used in combination, the size, corresponding to the axial direction of the dielectric resonance block, of the support frame with the dielectric constant greater than the air dielectric constant is slightly decreased on the basis of an original size.

Further, the cavity is of a cube-like shape, and in order to achieve coupling among three modes, on premise that a size of the cube-like dielectric resonance block is not changed, cut sides for achieving coupling of the three modes are processed on any two adjacent faces of the cavity, sizes of the cut sides are relevant to required coupling amounts; and a coupling of two of the three modes is achieved through the cut sides of the cube-like, and other coupling is achieved through cut corners of two adjacent sides of the cavity, walls are not broken when corners of the adjacent sides of the cavity are cut, and corner-cut faces need to be completely sealed with the cavity. The cavity is made of a metal or non-metal material, a surface of the metal or the non-metal material is electroplated by copper or electroplated by silver, and when the cavity is made of the non-metal material, the inner wall of the cavity is electroplated by a conductive material, for example, silver or copper, that is, a plastic or composite material is electroplated by copper or electroplated by silver.

Further, the irregular-shaped triple-mode cavity resonance structure is combined with a single-mode resonance structure, a dual-mode resonance structure and a triple-mode resonance structure in different modes to form filters of different volumes; a coupling of any two resonance cavities formed by permutation and combination by the irregular-shaped triple-mode cavity resonance structure and any one of a single-mode resonance cavity, a dual-mode resonance cavity and a triple-mode resonance cavity, resonance rods in the two resonance cavities are parallel, and the coupling is achieved through a size of a window between the two resonance cavities, the size of the window is determined according to coupling amounts; and the filter has function properties of band pass, band stop, high pass, low pass and a duplexer, a multiplexer and a combiner formed among the band pass, the band stop, the high pass and the low pass.

The dielectric constant of the cube-like dielectric resonance block of the disclosure is greater than the dielectric constant of the support frame, when the ratio of a size of a single side of the inner wall of the cavity to a size of a single side of the dielectric resonance block ranges from 1.03 to 1.30, the Q value of the higher-order mode is transited into the Q value of the base mode, the Q value of the base mode of the triple-mode dielectric is increased, the Q value of the higher-order mode is decreased, compared with a single-mode dielectric filter and a triple-mode dielectric filter known to inventors with same volumes and frequencies, the Q value is increased by 30% or above, and according to the combination of the triple-mode structure and different types of single cavities, for example, the combination of the triple-mode structure and a single mode cavity, the combination of a triple-mode and a TM mode, and the combination of a triple-mode and a TE single mode, the more the triple-mode structures are used in the filter, the smaller the filter size and the insertion loss are; and the triple-mode cavity resonance structure with the irregular-shaped cavity can generate triple-mode resonance in the X-axis, Y-axis and Z-axis directions, when generating triple-mode resonance in the X-axis, Y-axis and Z-axis directions.

When the ratio of the side length of the inner wall of the cavity to the corresponding side length of the dielectric resonance block is 1.0 to Q value transition point 1, the cavity is of a pure dielectric Q value when the ratio is 1.0, the Q value is continuously increased on the basis of the pure dielectric Q value when the size of the cavity is increased, the Q value of the higher-order mode is greater than the Q value of the base mode, and the original Q value of the higher-order mode is approximate to a new Q value of the base mode when the ratio is increased to transition point 1.

After entering transition point 1, in case of maintaining the resonance frequency of the base mode unchanged, the Q value of the base mode is greater than the Q value of the higher-order mode. Along with the increase of the ratio, as the sizes of the dielectric block and the cavity are both increased, the Q value of the base mode is also increased, the Q value of the higher-order mode is also increased, when the ratio approaches the Q value transition point 2, the Q value of the base mode reaches the highest, and between the Q value transition point 1 of the base mode and the Q value transition point 2 of the base mode, the frequency of the higher-order mode is far away from and close to the frequency of the base mode along with the change of the ratio of the cavity to the dielectric resonance block from transition point 1 to transition point 2.

After entering the transition point 2, the Q value of the base mode is smaller than the Q value of the higher-order mode, along with the increase of the ratio, the size of the dielectric resonance block is decreased, the size of the cavity is increased, and the Q value of the base mode is increased continuously, and when the ratio approaches the transition point 3, the Q value of the base mode approaches the Q value of the transition point 2.

After the ratio enters the transition point 3, the Q value of the base mode is increased along with the increase of the ratio, the Q value of the higher-order mode is decreased along with the increase of the ratio, the size of the dielectric resonance block is decreased along with the increase of the ratio, the size of the cavity is continuously increased, and when the size is close to ¾ of a wavelength size of the cavity, as the size of the dielectric resonance block is decreased continuously, the Q value of the base mode is decreased accordingly, and the frequency of the higher-order mode is far away from and close to the frequency of the base mode along with the increase of the ratio. A specific ratio of the transition point is related to the dielectric constant and the frequency of the dielectric resonance block and whether the dielectric resonance block has a single or composite dielectric constant.

The side length of the inner wall of the cavity and the side length of the dielectric resonance block may be equal or not in three directions, along the X, Y and Z axes. The cavity and the cube-like dielectric resonance block may form triple-mode when having equal sizes in the X-axis, the Y-axis and the Z-axis; size differences in three directions, along the X, Y and Z axes may also be slightly unequal, when the size of the single side of the cavity and the size of the corresponding single side of the dielectric resonance block in one of the X-axis, Y-axis and Z-axis directions is different from the sizes of the single sides in the other two directions, or any one of the sizes of symmetrical single sides of the cavity and the dielectric resonance block is different from the sizes of the single sides in the other two directions, the frequency of one of the three modes changes to be different from the frequencies of the other two modes, the greater the size difference is, the greater the difference between the frequencies of one mode of the three modes and the other two modes is, when the size in one direction is greater than the sizes in the other two directions, the frequency is decreased on the original basis, and when the size in one direction is smaller than the sizes in the other two directions, the frequency may be increased on the original basis, and triple-mode may gradually changes into a dual-mode or a single-mode; when difference among the three axial sizes of the cavity and the resonance block is too large, and when the sizes of the symmetrical single sides in three directions, along the X, Y and Z axes, are different, the frequencies of the three modes are different, under the condition that the side length sizes in the three directions are greatly different, the base mode is a single mode, and under the condition that the side length sizes in the three directions are not greatly different, the frequency difference is not large, and although the frequencies may change, a triple-mode state may still be maintained by the tuning device.

Coupling among the three modes may be achieved by providing at least two non-parallel coupling devices, for changing the orthogonal property of the electromagnetic field of the degenerate triple-mode in the cavity, in the triple-mode cavity resonance structure with the irregular-shaped cavity, the coupling device includes cut corners and/or holes provided beside the edges of the dielectric resonance block, or includes chamfers/cut corners provided beside edges of the cavity, or includes cut corners and/or holes provided beside the edges of the dielectric resonance block and chamfers/cut corners provided beside the edges of the cavity, or includes tapping lines/pieces provided on non-parallel planes in the cavity, the cut corners are of a triangular-prism shape, a cuboid shape or a sector shape, and the holes are of a circle shape, a rectangle shape or a polygon shape. After corner cutting or hole forming, in case of frequency maintenance, side lengths of the dielectric resonance block are increased, and the Q value is slightly decreased. Depths of the cut corners or holes are of through or partial cut corners/partial hole structures according to required coupling amounts, and the coupling amounts are affected by the sizes of the cut corners/chamfers/holes. A coupling screw is arranged on a coupling tuning structure in a direction perpendicular or parallel to the cut corners and/or a direction parallel to the holes; the coupling screw is made of a metal, or the coupling screw is made of a metal and the metal is electroplated by copper or electroplated by silver, or the coupling screw is made of a medium, or the coupling screw is made of a surface metallized medium; the coupling screw takes a shape of any one of metallic rods, medium rods, metallic discs, medium discs, metallic rods with metallic discs, metallic rods with medium discs, medium rods with metallic discs and medium rods with medium discs.

The resonance frequency of the three modes in the X-axis direction is achieved by additionally installing the tuning screw or the tuning disc at the place with concentrated field intensity on one or two faces of the cavity corresponding to the X axis so as to change the distance or change capacitance; the resonance frequency in the Y-axis direction is achieved by additionally installing the tuning screw or the tuning disc at the place with concentrated field intensity on one or two faces of the Y axis corresponding to the cavity so as to change the distance or change the capacitance; and the resonance frequency in the Z-axis direction is achieved by additionally installing the tuning screw or the tuning disc at the place with concentrated field intensity on one or two faces of the Z axis corresponding to the cavity so as to change the distance or change the capacitance.

The triple-mode structure with Q value transition of the dielectric resonant is arbitrarily arranged and combined with the single-mode resonance structure, the dual-mode resonance structure and the triple-mode resonance structure in different modes to form required filters of different sizes; the filter has function properties of band pass, band stop, high pass, low pass and the duplexer, the multiplexer formed among the band pass, the band stop, the high pass and the low pass; and coupling of any two resonance cavities formed by permutation and combination of the single-mode resonance structure, the dual-mode resonance structure and the triple-mode resonance structure is achieved through the size of the window between the two resonance cavities when resonance rods in two resonance structures are parallel.

Some embodiments of the disclosure have the beneficial effects that the structure is simple in structure and convenient to use; by setting the ratio of the size of the single side of the inner wall of a metallic cavity of a dielectric triple mode to the size of the single side of the dielectric resonance block within 1.01-1.30, the resonance rod is matched with the cavity to form the triple-mode structure while reverse turning of specific parameters is achieved, and thus a high Q value is ensured when the resonance rod and the cavity are at a small distance apart. Furthermore, some embodiments disclose a filter with the irregular-shaped triple-mode cavity resonance structure, and compared with a triple-mode filter known to inventors, the filter has insertion loss reduced by 30% or greater on premise of same frequencies and same volumes. Dielectric resonant frequency transition triple-mode structures formed by the cube-like dielectric resonance block, the dielectric support frame and the cover plate of the cavity of the disclosure have magnetic fields orthogonal to and perpendicular to one another in directions of the X, Y and Z axes, thus three non-interfering resonance modes are formed, a higher-order mode frequency is transited into a high Q value base-mode frequency, coupling is formed among three magnetic fields, and different bandwidth demands of the filters are met by adjusting coupling intensity. When two filters with the irregular-shaped triple-mode cavity resonance structure are used in a typical 1800 MHz frequency filter, a volume equivalent to six single cavities of an original cavity is achieved, the volume may be reduced by 40% on the basis of an original cavity filter, and the insertion loss may also be reduced by about 30%. Since the volume is greatly reduced, and the processing time and electroplating areas are correspondingly reduced, the cost is still equivalent to the cost of the cavity although the dielectric resonance block is used, if the material cost of the dielectric resonance block is greatly reduced, the design may have obvious cost advantages, when the filter has multiple cavities, three triple-mode structure may be used, and volume and performance may be obviously improved. Furthermore, on premise that the Q value of a single cavity is not greatly decreased, on the basis of the triple-mode resonance structure, a structure of the dielectric resonance block and/or cavity is changed (at least one irregular-shaped end face is provided), so that the tuning range of the tuning screw is increased, meanwhile, the sensitivity to resonance frequencies is reduced due to the small distance between the cavity and the dielectric resonance block, thereby facilitating production debugging and reducing production cost.

A high Q value triple-mode dielectric resonance structure has obvious advantages in terms of volume. And in case of the single cavity has a smaller volume, the Q value of the cavity high Q value multi-mode dielectric resonance structure is obviously greater than the Q value of the single cavity of other forms, the high Q value triple-mode dielectric resonance structure reduces the filter volume by more than 30%, and the loss of the filter may also be reduced by 30%. When a filter having the high Q value triple-mode dielectric resonance structure and a filter known to inventors have the same properties, the filter having the high Q value triple-mode dielectric resonance structure reduces the filter volume by more than 50% compared with the cavity filter known to inventors.

An irregular-shaped multi-mode cavity resonance structure described in following embodiments includes:

a cavity is irregular-shaped and concave, a dielectric resonance block is irregular-shaped and convex, and a dielectric support frame;

a cavity is irregular-shaped and convex, a dielectric resonance block is irregular-shaped and concave, and a dielectric support frame;

the dielectric support frame is manufactured in match with an irregular-shaped structure, and the number may be one or more. Shapes may be regular shapes such as solid/hollow cylinders, solid/hollow square columns, or may also be irregular shapes, or are composed of multiple columns.

In order to ensure multiple modes and corresponding frequencies, the irregular-shaped structure is not infinitely concave or convex but is subjected to limitation conditions. An example is taken for explanation, and others can be similarly obtained.

Eg: single cavity 26 mm*26 mm*26 mm, the dielectric support frame is Er9.8, Q*f is 100,000, an outer diameter is 5 mm, an inner diameter is 9.7 mm, the dielectric resonance rod is Er43, and Q*f is 43,000.

The longest side length 25.97 of the dielectric resonance block is already approximate to a side length 26 mm of the cavity, therefore, the concave size is 1.5 mm at most.

To understand the disclosure clearly, the disclosure is specifically described with specific embodiments and figures, and the description does not constitute any limitation to the disclosure.

Figure 2:
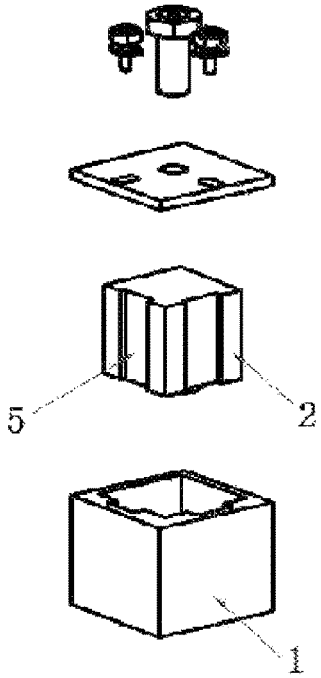
FIG. 2 shows a structural schematic diagram of an irregular-shaped triple-mode cavity resonance structure of an embodiment of the disclosure; wherein a dielectric resonance block is concave, a cavity is convex, the resonance screws are all arranged on a cover plate.
Figure 3:
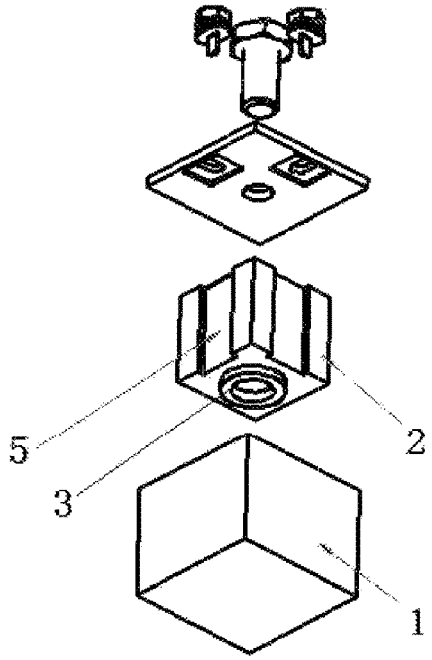
FIG. 3 shows a bottom view of an irregular-shaped triple-mode cavity resonance structure of the disclosure, wherein a dielectric resonance block is concave, a cavity is convex, and resonance screws are all arranged on a cover plate.

As shown in FIG. 1 to FIG. 3, an irregular-shaped triple-mode cavity resonance structure of the disclosure includes a cavity 1, wherein the cavity 1 is internally provided with a dielectric resonance block 2 and a dielectric support frame 3. The dielectric resonance block 2 is of a cube-like shape and one or more nonparallel end faces are convex; a convex part of the cavity 1 is formed by partially forming grooves 5 in one or more nonparallel end faces of an inner wall of the cavity. Six end faces of the dielectric resonance block 2 is connected with the inner walls of the cavity 1 through six dielectric support frames 3 respectively; 3 tuning screws are arranged on a cover plate, 3 tuning screws are arranged in a mutual perpendicular manner in pairs.

Figure 4:
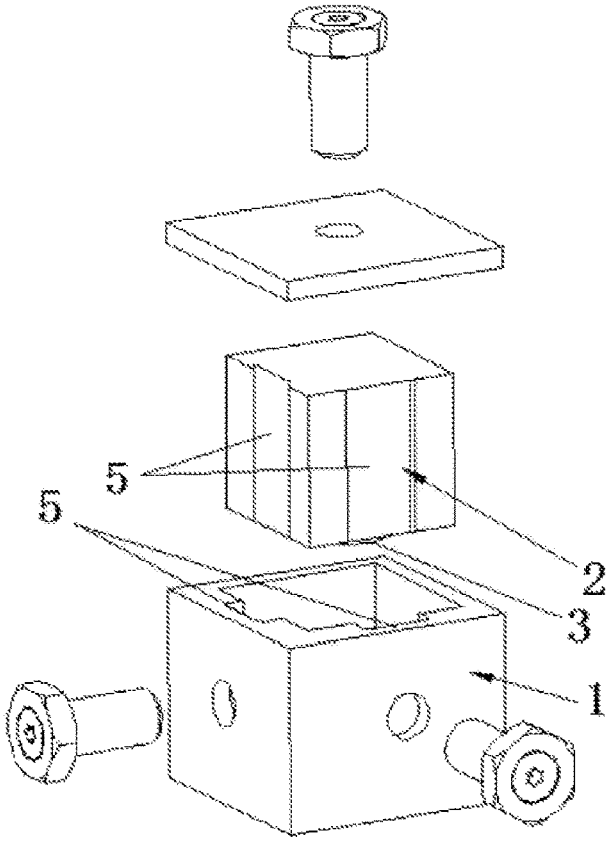
FIG. 4 shows a structural schematic diagram of an irregular-shaped triple-mode cavity resonance structure of an embodiment of the disclosure; wherein a dielectric resonance block is concave, a cavity is convex, and resonance screws are arranged on a cover plate and a cavity separately.

As shown FIG. 4, an irregular-shaped triple-mode cavity resonance structure of the disclosure includes a cavity 1, wherein the cavity 1 is internally provided with a dielectric resonance block 2 and a dielectric support frame 3; the dielectric resonance block 2 is of a cube-like shape; and one or more nonparallel end faces are convex; a convex, part of the cavity 1 is formed by partially forming grooves 5 in one or more nonparallel end faces of an inner wall of the cavity. Six end faces of the dielectric resonance block 2 is connected with the inner walls of the cavity 1 through six dielectric support frames 3 respectively; tuning screws are arranged on a cover plate and the cavity, 3 tuning screws are arranged in a mutual perpendicular manner in pairs.

The above embodiments are only some embodiments of the disclosure and do not constitute any limitation to the disclosure, particularly shapes and numbers of the dielectric support frames.

Directions of three edges perpendicular to one another in the dielectric resonance block 2 are respectively defined as an X direction, a Y direction and a Z direction, the three directions are relative position directions and are not solely determined. The dielectric resonance block 2 forms an X-axis dielectric resonance rod, a Y-axis dielectric resonance rod, and a Z-axis dielectric resonance rod, with corresponding dielectric support frames in the three X, Y and Z directions. The X-axis dielectric resonance rod, the Y-axis dielectric resonance rod and the Z-axis dielectric resonance rod are matched with an interior of the cavity to form three degenerate modes; a resonance frequency in the direction of the X axis, can be achieved by additionally installing a tuning screw on a side wall corresponding to a metallic cavity to change a distance or change capacitance; a resonance frequency in the direction of the Y axis can be achieved by additionally installing a tuning screw on a side wall corresponding to a metallic cavity to change a distance or change capacitance; a resonance frequency in the direction of the Z axis can be achieved by additionally installing a tuning screw on a side wall corresponding to a metallic cavity to change a distance or change capacitance.

A radio frequency signal has loss, after triple-mode resonance, heat is generated when three degenerate modes in X, Y and Z directions in working, heat conduction can be achieved by enabling the dielectric resonance block and multiple dielectric support frames to sufficiently contact with walls of the metallic cavity, and thus a filter can work stably for a long time.

Coupling devices 5 are arranged between every two of the three degenerate modes, particularly: the dielectric resonance block 2 is provided with a first plane j1 for coupling resonance modes in the X direction and the Y direction, a second plane j2 for coupling resonance modes in the Y direction and the Z direction, and a third plane j3 for coupling resonance modes in the X direction and the Z direction, every two of the first plane j1, the second plane j2 and the third plane j3 are respectively perpendicular to each other. The first plane j1 is parallel to an edge arranged along the Z direction, the second plane j2 is parallel to an edge arranged along the X direction, and the third plane is parallel to an edge arranged along the Y direction. That is, in the three degenerate modes, coupling of a degenerate mode in the X direction with a degenerate mode in the Y direction is achieved by the first plane j1 which is formed by cutting off a part of a corner along the direction of the Z axis, and the corner is formed by cross X and Y planes of a dielectric resonance block A. Coupling of a degenerate mode in the X direction with a degenerate mode in the Z direction is achieved by the second plane j2 which is formed by cutting off a part of a corner along the direction of the X axis and the corner is formed by cross Y and Z planes of a dielectric resonance block. Coupling of a degenerate mode in the Y direction with a degenerate mode in the Z direction is achieved by the third plane j3 which is formed by cutting off a part of a corner along the direction of the Y axis and the corner is formed by cross Z and X planes of a dielectric resonance block. The larger the area of a coupling surface is, the larger the coupling amount is, and the smaller the coupling amount is otherwise. Transmission zero points may be formed by cross coupling of three degenerate modes formed by the dielectric resonance block. If coupling of an X direction resonance mode and a Y direction resonance mode and coupling of a Y direction resonance mode and a Z direction resonance mode are main coupling, coupling of the X direction resonance mode and the Z direction resonance mode is cross coupling.

In the above solution, according to actual coupling amounts, one or more first planes j1 are arranged. When more first planes j1 are arranged, the more first planes j1 are arranged in parallel. One or more second planes j2 are arranged. When more second planes j2 are arranged, the more second planes j2 are arranged in parallel. One or more third planes j3 are arranged. When more third planes j3 are arranged, the more third planes j3 are arranged in parallel.

In the above solution, the dielectric resonance block 2 is directly formed by a cube-like shape with approximate side lengths or by a cube medium with equal side lengths, the cube medium is formed by convex setting at least one end face, or by overall or partially growing films on a surface, or is composed of cube-like shapes with approximate side lengths or cube mediums with equal side lengths, the cube mediums is formed by convex setting at least one end face and overall or partially growing film mediums. The dielectric resonance block is made of a ceramic or medium.

In some embodiments, the dielectric resonance block 2 is directly formed by a cube-like shape with approximate side lengths or by directly concaving at least one end face of a cube medium with equal side lengths, or is composed of cube-like shapes with approximate side lengths or cube mediums with equal side lengths, the cube mediums is formed by concaving at least one end face and overall or partially growing film mediums. The dielectric resonance block 2 is made of a ceramic or medium.

In the above solution, one or more dielectric support frames 3 are designed. When more dielectric support frames 3 are arranged, the more dielectric support frames 3 are respectively installed between different faces of the dielectric resonance block 2 and inner walls of the cavity. FIG. 1 of an embodiment of the disclosure shows six dielectric support frames 3. The dielectric resonance block is positioned in the center of the six dielectric support frames. Six faces A1-A6 of the dielectric resonance block 2 are respectively connected with the six dielectric support frames 3. In an embodiment, the six dielectric support frames 3 are respectively a first dielectric support frame B1, a second dielectric support frame B2, a third dielectric support frame B3, a fourth dielectric support frame B4, a fifth dielectric support frame B5 and a sixth dielectric support frame B6. An end face A1 of dielectric resonance block 3 along the X direction is connected with the first dielectric support frame B1, and another end face A2 is connected with the second dielectric support frame B2, thus to form an X-axis dielectric resonance rod. An end face A3 of the dielectric resonance block 2 along the Y direction is connected with the third dielectric support frame B3, and another end face A4 is connected with the fourth dielectric support frame B4, thus to form a Y-axis dielectric resonance rod. An end face A5 of the dielectric resonance block 2 along the Z direction is connected with the fifth dielectric support frame B5, and another end face A6 is connected with the sixth dielectric support frame B6.

Shapes of more dielectric support frames 3 include, but not limited to, circles, ellipses, squares and irregular shapes that inner walls of the cavity are tightly matched with corresponding medium end faces. Materials of the dielectric support frame 3 include, but not limited to, plastics, mediums and air, and the dielectric support frame is of a solid structure or a structure with a hollow center. The dielectric resonance block 2 and the dielectric support frame 3 are connected in modes of, but not limited to, gluing and crimping. The dielectric resonance block and the dielectric support frame are connected in modes of, but not limited to, gluing, crimping, screw fastening and welding. The cavity takes a cube-like shape or a cube shape. The cavity is made of a metallic material, or the cavity is made of a metallic material and an inner wall of the metallic material is coated by silver or copper, or the cavity is made of a nonmetallic material of which the surface is coated by a metallic layer. In order to reduce variation of frequencies at different ambient temperatures, material proportions of the dielectric resonance block may be adjusted according to different temperature divination to control frequency deviation, in addition, in order to ensure structure reliability, the dielectric support frame is made of an elastic material such as a plastic, so that the dielectric support frame of the structure is capable of counteracting influence of thermal expansion and cold contraction in different environments.

The dielectric support frame of the solid structure takes a shape of a solid structure, or is of a through tubular structure in the middle, or is a combination of multiple independent solid columns;

the dielectric support frame of the solid structure is made of plastics, ceramics or mediums, and a dielectric support frame of a non-solid structure is made of air.

Two end faces of the dielectric resonance block along the X direction are connected with the first dielectric support frame and the second dielectric support frame in a mode of gluing or crimping. Two end faces of the dielectric resonance block along the Y direction are connected with the third dielectric support frame and the fourth dielectric support frame in a mode of gluing or crimping. Two end faces of the dielectric resonance block along the Z direction are connected with the fifth dielectric support frame and the sixth dielectric support frame in a mode of gluing or crimping.

Furthermore, a total resonance rod formed by resonance rods in three X, Y and Z directions and the cavity form a triple-mode resonance cavity structure. The cavity takes the cube shape or cube-like shape. The cavity is made of the metallic material, or the cavity is made of the metallic material and the inner wall of the metallic material is, coated by silver or copper, or the cavity is made of the nonmetallic material of which the surface is coated by the metallic layer.

Furthermore, the total resonance rod formed by resonance rods in three X, Y and Z directions is connected with the inner wall of the cavity in a mode of gluing, crimping, screw fastening or welding. The total resonance rod formed by resonance rods in three X, Y and Z directions has compensation of frequencies along with temperature variation. The structure of the dielectric support frame of the total resonance rod formed by resonance rods in three X, Y and Z directions counteracts influence caused by thermal expansion and cold contraction in different environments by using a material of certain elasticity or a shape of an elastic structure, and the elastic material of the dielectric support frame is a plastic, a medium, a composite material, aluminum oxide and the like.

In the above solution, the resonance frequency of the degenerate triple mode in the direction of the X axis is achieved by additionally installing the tuning screw or the tuning disc at the place with concentrated field intensity on one or two faces of the X axis corresponding to the cavity so as to change the distance or change capacitance; the resonance frequency in the direction of the Y axis is achieved by additionally installing the tuning screw or the tuning disc at the place with concentrated field intensity on one or two faces of the axis corresponding to the cavity so as to change the distance or change capacitance; and the resonance frequency in the direction of the Z axis is achieved by additionally installing the tuning screw or the tuning disc at the place with concentrated field intensity on one or two faces of the Z axis corresponding to the cavity so as to change the distance or change capacitance;

the tuning screw or the tuning disc is made of a metal, or the tuning screw or the tuning disc is made of a metal and the metal is electroplated by copper or electroplated by silver, or the tuning disc or the tuning disc is made of a medium, or the tuning screw or the tuning disc is made of a surface metallized medium; and the tuning screw is of the shape of any one of metallic rods, medium rods, metallic discs, medium discs, metallic rods with metallic discs, metallic rods with medium discs, medium rods with metallic discs and medium rods with medium discs.

In the above solution, at least two nonparallel arranged coupling structures for breaking orthogonality of degenerate multi-mode electromagnetic fields in the cavity are disposed on the dielectric resonance block and/or non-corresponding parts of the cavity. The coupling structures include cut corners and holes arranged beside the edges of the irregular-shaped dielectric resonance block and/or cut corners beside the edges of the cavity. The cut corners are of a triangular prism shape or cube-like shape or sector shape. In the three degenerate modes, coupling of a degenerate mode in the X direction with a degenerate mode in the Y direction is achieved by a first plane which is formed by cutting off a part of a corner along the direction of the Z axis and the corner is formed by cross X and Y planes of the dielectric resonance block. Coupling screws are disposed on edges formed by cross X and Y planes of the cavity in a parallel or perpendicular manner to achieve fine tuning of coupling amounts. Coupling of the degenerate mode in the Y direction with a degenerate mode in the Z direction is achieved by a second plane which is formed by cutting off a part of a corner along the direction of the X axis, and the corner is formed by cross Y and Z planes of the dielectric resonance block. Coupling screws are disposed on edges formed by cross Y and Z planes of the cavity in a parallel or perpendicular manner to achieve fine tuning of coupling amounts. Coupling of the degenerate mode in the Z direction with the degenerate mode in the X direction is achieved by a third plane which is formed by cutting off a part of a corner along the direction of the Y axis, and, the corner is formed by cross Z and X planes of a dielectric resonance block. Coupling screws are disposed on edges formed by cross Z and X planes of the cavity in a parallel or perpendicular manner to achieve fine tuning of coupling amounts;

the coupling screw is made of a metal, or the coupling screw is made of a metal and the metal is electroplated by copper or electroplated by silver, or the coupling screw is made of a medium, or the coupling screw is made of a surface metallized medium; and the coupled screw takes a shape of any one of metallic rods, medium rods, metallic discs, medium discs, metallic rods with metallic discs, metallic rods with medium discs, medium rods with metallic discs and medium rods with medium discs.

Furthermore, a radio frequency channel is formed by coupling of a resonance mode in the X direction and a resonance mode in the Y direction and coupling of a resonance mode in the Y direction and a resonance mode in the Z direction to cause loss and generate heat, the six dielectric support frames are sufficiently connected with the inner wall of the cavity to achieve heat conduction, and thus the heat is dissipated.

Furthermore, multi-mode resonance structures with small distances, single-mode resonance cavities, dual-mode resonance cavities or triple-mode resonance cavities of different modes are combined in different modes to form filters of different volumes;

the filter has function properties of band pass, band stop, high pass, low pass and a combiner formed among the band pass, the band stop, the high pass and the low pass; and a coupling of any two resonance cavities formed by permutation and combination by the irregular-shaped triple-mode cavity resonance structure and any one of a single-mode resonance cavity, a dual-mode resonance cavity and a triple-mode resonance cavity, resonance rods in the two resonance cavities are parallel, and the coupling is achieved through a size of a window between the two resonance cavities.

It should be understood, that the above is only embodiments of the disclosure, but the scope of protection of the disclosure is not limited to this. Changes or replacements easily made by any of those skilled in the art within the scope of the technology disclosed by the disclosure shall be covered by the scope of protection of the disclosure. The contents not described in detail in the description belong to the conventional art known to those skilled in the art.

What is claimed is:

1. An irregular-shaped triple-mode cavity resonance structure, comprising a cavity and a cover plate, wherein the cavity is internally provided with a dielectric resonance block and a dielectric support frame, wherein the cavity is of a cube-like shape, at least one end face of the cavity is concave, the dielectric resonance block is of a cube-like shape, at least one end face of the dielectric resonance block is convex, the dielectric support frame is respectively connected with the dielectric resonance block and an inner wall of the cavity, the dielectric resonance block and the dielectric support frame form a triple-mode dielectric resonance rod, and a dielectric constant of the dielectric support frame is smaller than a dielectric constant of the dielectric resonance block;

a ratio K of a size of a single side of the inner wall of the cavity to a size of a corresponding single side of the dielectric resonance block meets: transition point 1≤K≤transition point 2, a Q value of a higher-order mode, adjacent to a base mode, of the triple-mode dielectric resonance structure is transited into a Q value of the base mode of the triple-mode dielectric resonance structure, a base mode resonance frequency after transition is equal to a base mode resonance frequency prior to transition, a Q value of the base mode after transition is greater than a Q value of the base mode prior to transition, and a Q value of the higher-order mode, adjacent to the base mode, after transition is smaller than a Q value of the higher-order mode, adjacent to the base mode, prior to transition;

the triple-mode dielectric resonance structure is internally provided with a coupling structure for changing an orthogonal property of a degenerate triple-mode electromagnetic field in the cavity; and the triple-mode dielectric resonance structure is internally provided with a frequency tuning device for changing a resonance frequency of the degenerate triple-mode in the cavity.

2. The irregular-shaped triple-mode cavity resonance structure as claimed in claim 1, wherein the dielectric resonance block is of a solid structure or a hollow structure; and a hollow part of the dielectric resonance block of the hollow structure is filled with air or a nested dielectric resonance block, and a volume of the nested dielectric resonance block is smaller than or equal to a volume of a hollow chamber.

3. The irregular-shaped triple-mode cavity resonance structure as claimed in claim 2, wherein the nested dielectric resonance block is of a cube-like shape, and at least one end face of the nested dielectric resonance block is concave or convex.

4. The irregular-shaped triple-mode cavity resonance structure as claimed in claim 3, wherein a film medium is arranged on at least one end face of the nested dielectric resonance block.

5. The irregular-shaped triple-mode cavity resonance structure as claimed in claim 1, wherein a film medium is arranged on the concave end face of the cavity or/and the convex end face of the dielectric resonance block.

6. The irregular-shaped triple-mode cavity resonance structure as claimed in claim 1, wherein a value of the transition point 1 and a value of the transition point 2 both vary according to different base mode resonance frequencies of the dielectric resonance block, the dielectric constant of the dielectric resonance block and the dielectric constant of the support frame.

7. The irregular-shaped triple-mode cavity resonance structure as claimed in claim 1, wherein when the base mode resonance frequency of the dielectric resonance block after transition remains unchanged, the Q value of the triple-mode dielectric resonance structure is related to the K value, the dielectric constant of the dielectric resonance block and the size of the dielectric resonance block.

8. The irregular-shaped triple-mode cavity resonance structure as claimed in claim 1, wherein when the K value is increased to a maximum from 1.0, the K value has three Q value transition points within a variation range, and each Q value transition point enables the Q value of the base mode of the K value and the Q value of the higher-order mode, adjacent to the base mode, of the K value to be transited; when the Q value of the base mode is lower than the Q value of the higher-order mode, adjacent to the base mode, the Q value of the higher-order mode, adjacent to the base mode, is transited into the Q value of the base mode, and the Q value of the base mode after transition is higher than the Q value of the base mode prior to transition; and when the Q value of the base mode is higher than the Q value of the higher-order mode, adjacent to the base mode, the Q value of the higher-order mode, adjacent to the base mode, is transited into the Q value of the base mode, and the Q value of the base mode after transition is lower than the Q value of the base mode prior to transition.

9. The irregular-shaped triple-mode cavity resonance structure as claimed in claim 8, wherein in four areas formed by a starting point and a final point of the K value and the three Q value transition points, the Q value of the base mode and the Q value of the higher-order mode, adjacent to the base mode, vary along variation of cavity sizes and dielectric resonance rod block sizes, and different areas have different requirements when being applied to a filter.

10. The irregular-shaped triple-mode cavity resonance structure as claimed in claim 1, wherein when the cavity and the dielectric resonance block have a same size in X, Y and Z axes, a degenerate triple mode is formed, and the degenerate triple mode is coupled with other single cavities to form a pass-band filter;

when differences of sizes of the cavity and the dielectric resonance block in three directions, along the X, Y and Z axes, are slightly unequal, orthogonal-like triple-mode resonance is formed, if the orthogonal-like triple-mode is capable of coupling with other cavities into a pass-band filter, the sizes are acceptable, and if the orthogonal-like triple-mode is not capable of coupling with other cavities into the pass-band filter, the sizes are unacceptable; and when the differences of the sizes of the cavity and the dielectric resonance block in the three directions along the X, Y and Z axes are greatly different, the degenerate triple-mode or the orthogonal-like triple-mode can not be formed, three modes of different frequencies are formed instead, thus the modes can not be coupled with other cavities into the pass-band filter, and the sizes are unacceptable.

11. The irregular-shaped triple-mode cavity resonance structure as claimed in claim 10, wherein the triple-mode dielectric resonance structure forms the degenerate triple-mode in directions along the X, Y and Z axes, a resonance frequency of the degenerate triple-mode in an X-axis direction is achieved by additionally installing a tuning screw or a tuning disc at a place with concentrated field intensity on one or two faces, corresponding to the cavity, of the X-axis so as to change a distance or change capacitance; a resonance frequency in a Y-axis direction is achieved by additionally installing a tuning screw or a tuning disc at a place with concentrated field intensity on one or two faces, corresponding to the cavity, of the Y-axis so as to change a distance or change capacitance; and a resonance frequency in a Z-axis direction is achieved by additionally installing a tuning screw rod or a tuning disc at a place with concentrated field intensity on one or two faces, corresponding to the cavity, of the Z-axis so as to change a distance or change capacitance.

12. The irregular-shaped triple-mode cavity resonance structure as claimed in claim 10, wherein the triple-mode dielectric resonance structure forms the degenerate triple-mode in the directions along the X, Y and Z axes, and the frequency of the degenerate triple-mode is adjusted by changing a dielectric constant; dielectric constant films of different shapes and thicknesses are adhered to a surface of the dielectric resonance block, an inner wall of the cavity, an inner wall of the cover plate or a bottom of the tuning screw, the dielectric constant films are made of a ceramic medium or a ferroelectric material;

the tuning screw or the tuning disc is made of a metal, or the tuning screw or the tuning disc is made of a metal and the metal surface is electroplated by copper or electroplated by silver, or the tuning screw or the tuning disc is made of a medium, or the tuning screw or the tuning disc is made of a surface metalized medium; and the shape, of the tuning screw is any one of metallic rods, medium rods, metallic discs, medium discs, metallic rods with metallic discs, metallic rods with medium discs, medium discs with metallic discs and medium rods with medium discs.

13. The irregular-shaped triple-mode cavity resonance structure as claimed in claim 1, wherein the triple-mode dielectric resonance structure is internally provided with at least two non-parallel arranged coupling devices for changing the orthogonal property of the degenerate triple-mode electromagnetic field in the cavity, each coupling device comprises cut come s/chamfers/grooves disposed on edges of the dielectric resonance block, or comprises chamfers/cut corners disposed at inner corners of the cavity, or comprises cut corners/chamfers/grooves disposed beside edges of the dielectric resonance block and chamfers/cut corners disposed beside edges of the cavity, or comprises tapping lines or/pieces arranged on non-parallel planes in the cavity;

the cut corners are of a triangular-prism shape, a cuboid shape or a sector shape; after corner cutting, in case of frequency holding, side lengths of the dielectric resonance block are increased, and the Q value is slightly decreased;

depths of the cut corners or holes are of through or partial cut corners/partial hole structures according to the required coupling amounts;

the coupling amounts are affected by sizes of the cut corners/chamfers/holes;

the coupling tuning structure comprises a coupling screw disposed in a direction perpendicular or parallel to the cut corners, the coupling screw is made of a metal, or the coupling screw is made of a metal and the metal surface is electroplated by copper or electroplated by silver, or the coupling screw is made of a medium, or the coupling screw is made of a surface metalized medium; and the shape of the coupling screw is any one of metallic rods, medium rods, metallic discs, medium discs, metallic rods with metallic discs, metallic rods with medium discs, medium discs with metallic discs and medium rods with medium discs.

14. The irregular-shaped triple-mode cavity resonance structure as claimed in claim 1, wherein the triple-mode dielectric resonance structure is internally provided with at least two non-parallel arranged coupling devices for changing the orthogonal properties of a degenerate triple-mode electromagnetic field in the cavity, each coupling device comprises holes/grooves arranged on an end face of the dielectric resonance block, center lines of the holes or grooves are parallel to edges perpendicular to the end faces with holes or grooves of the dielectric resonance block;

or comprises a chamfers/cut corners arranged at an inner corners of the cavity, or comprises holes/grooves arranged in the end faces of the dielectric resonance block and chamfers/cut corners arranged beside edges of the cavity, or comprises tapping lines or/pieces arranged on a non-parallel planes in the cavity;

depths of the holes are of through hole structures or partial hole structures according to required coupling amounts;

the coupling amounts are affected by the sizes of the holes;

the holes/grooves are of a circular shape, a rectangular shape or a polygonal shape, and after the holes/grooves are formed, in case of frequency holding, side lengths of the dielectric resonance block are increased, and the Q value is slightly decreased;

the coupling tuning structure comprises a coupling screw disposed in a direction parallel to the holes, the coupling screw is made of a metal, or the coupling screw is made of a metal and the metal surface is electroplated by copper or electroplated by silver, or the coupling screw is made of a medium, or the coupling screw is made of a surface metallized medium; and the shape of the coupling screw is any one of metallic rods, medium rods, metallic discs, medium discs, metallic rods with metallic discs, metallic rods with medium discs, medium discs with metallic discs and medium rods with medium discs.

15. The irregular-shaped triple-mode cavity resonance structure as claimed in claim 1, wherein the cavity is of a cube-like shape, to achieve coupling of three modes, on premise that the size of the dielectric resonance block is not changed, cut sides for achieving coupling of the three modes are processed on any two adjacent faces of the cavity, sizes of the cut sides are relevant to required coupling amounts; a coupling of two of the three modes is achieved through the cut sides of the cavity, and other coupling is achieved through cut corners of two adjacent sides of the cavity, walls are not broken when corners of the adjacent sides of the cavity are cut, and corner-cut faces need to be completely sealed with the cavity; a surface of the cavity is electroplated by copper or electroplated by silver, and the cavity is made of a metal or a non-metal material; and when the cavity is made of the non-metal material, the inner wall of the cavity is electroplated by a conductive material.

16. The irregular-shaped triple-mode cavity resonance structure as claimed in claim 1, wherein when the cavity is of the cube-like shape, the dielectric resonance block and the dielectric support frame are installed in any one axial direction of the cavity and a center of the dielectric resonance block coincides with or approaches to a center of the cavity.

17. The irregular-shaped triple-mode cavity resonance structure as claimed in claim 1, wherein the dielectric constant of the dielectric support frame is similar to an air dielectric constant, and the dielectric support frame has no influence on the resonance frequency of the triple-mode; and the dielectric support frame supports with any one single face of the dielectric resonance block, or supports with six faces, or supports with different combinations of different two faces, three faces, four faces and five faces, a number of the dielectric support frame on each face is one or more; and one or more support frames is installed on different faces according to demands.

18. The irregular-shaped triple-mode cavity resonance structure as claimed in claim 17, wherein a single face support combination is any one face for supporting the dielectric resonance block, especially a bottom face in a vertical direction or a bearing face;

a two faces support combination comprises parallel faces such as upper and lower faces, front and rear faces and left and right faces, and also comprises nonparallel faces such as upper and front faces, upper and rear faces, upper and left faces and upper and right faces;

a three faces support combination comprises three faces perpendicular to one another, or two parallel faces and one nonparallel face;

a four faces support combination comprises two pairs of parallel faces or a pair of parallel faces and two another nonparallel faces;

a support combination of five faces comprises support structures on other faces except any one face of a front face/a rear face/a left face/a right face/an upper face/a lower face; and a support combination of six faces comprises support structures on all faces of a front face/a rear face/a left face/a right face/an up face/a down face.

19. The irregular-shaped triple-mode cavity resonance structure as claimed in claim 1, wherein the dielectric constant of the dielectric support frame is greater than an air dielectric constant and smaller than the dielectric constant of the dielectric resonance block; to hold original triple-mode frequencies, a size, corresponding to an axial direction, of the dielectric resonance block of the dielectric support frame is slightly reduced; the dielectric support frame supports with any one single face of the dielectric resonance block, or supports with six faces, or supports with different combinations of two different faces, three faces, four faces and five faces, a face without the support frame is an air face, the air face is arbitrarily combined with the dielectric support frame; a number of the dielectric support frame on each face is one or more, or the dielectric support frame on each face is a complex dielectric constant support frame composed of multiple layers of different dielectric constant medium materials, single-layer and multi-layer medium material support frames are arbitrarily combined with a cube-like medium block one or more dielectric support frames is installed on different faces according to demands, on faces with the dielectric support frames, to hold the triple-mode frequencies and the Q value, the size, corresponding to the axial direction of the dielectric resonance block, of the dielectric support frame is slightly decreased.

20. The irregular-shaped triple-mode cavity resonance structure as claimed in claim 19, wherein a single face support combination is any one face for supporting the dielectric resonance block, especially a bottom face in a vertical direction or a bearing face;

a two faces support combination comprises parallel faces such as upper and lower faces, front and rear faces and left and right faces, and also comprises nonparallel faces such as upper and front faces, upper and rear faces, upper and left faces and upper and right faces;

a three faces support combination comprises three faces perpendicular to one another, or two parallel faces and one nonparallel face;

a four faces support combination comprises two pairs of parallel faces or a pair of parallel faces and two another nonparallel faces;

a support combination of five faces comprises support structures on other faces except any one face of a front face/a rear face/a left face/a right face/an upper face/a lower face; and a support combination of six faces comprises support structures on all aces of a front face/a rear face/a left face/a right face/an up face/a down face.

21. The irregular-shaped triple-mode cavity resonance structure as claimed in claim 1, wherein a surface area of the dielectric support frame is smaller than or equal to a surface area of the dielectric resonance block; the dielectric support frame is of a cylinder shape, a cube shape or a cuboid shape;

the dielectric support frame is of a solid structure or a hollow structure, and the dielectric support frame of the hollow structure has a single hole or multiple holes, each hole takes a shape of a circle, a square, a polygon and an arc; and the dielectric support frame is made of air, plastics, ceramics or mediums.

22. The irregular-shaped triple-mode cavity resonance structure as claimed in claim 1, wherein the dielectric support frame and the dielectric resonance block are connected in a mode of crimping, adhesion or sintering; and the dielectric support frame and the inner wall of the cavity are connected in a mode of adhesion, crimping, welding, sintering or screw fixation.

23. The irregular-shaped triple-mode cavity resonance structure as claimed in claim 1, wherein a radio frequency channel formed by coupling, of radio frequency signals in directions of X, Y and Z axes of the triple mode causes loss and generates heat, the dielectric resonance block is sufficiently connected with the inner wall of the cavity through the dielectric support frame, and thus the heat is conducted into the cavity for heat dissipation.

24. The irregular-shaped triple-mode cavity resonance structure as claimed in claim 1, wherein a frequency temperature coefficient of the dielectric resonance block is controlled by adjusting proportions of medium materials, and is compensated according to frequency deviation variation of a filter at different temperatures.

25. The irregular-shaped triple-mode cavity resonance structure as claimed in claim 24, wherein the dielectric resonance block has a single dielectric constant or composite dielectric constants; the dielectric resonance block with the composite dielectric constants is formed by at least two materials of different dielectric constants; the materials of different dielectric constants are combined up and down, left and right, asymmetrically or in a nested mode; when the materials of different dielectric constants are nested in the dielectric resonance block, one or more layers are nested; the dielectric resonance block with the composite dielectric constants needs to comply with variation rules of the Q value transition points; when the dielectric resonance block is subjected to cut side coupling among triple modes, to hold a required frequency, corresponding side lengths of two faces adjacent to the cut sides are parallelly adjusted; the dielectric resonance block is made of a ceramic or medium material; and medium sheets of different thicknesses and different dielectric constants are added on a surface of the dielectric resonance block.

26. A filter having a irregular-shaped triple-mode cavity resonance structure, comprising a cavity, a cover plate and an input/output structure, wherein the cavity is internally provided with at least one irregular-shaped triple-mode cavity resonance structure as claimed in claim 1;

the irregular-shaped triple-mode cavity resonance structure is combined with a single-mode resonance structure, a dual-mode resonance structure and a triple-mode resonance structure in different modes to form filters of different volumes;

a coupling of any two resonance cavities formed by permutation and combination by the irregular-shaped triple-mode cavity resonance structure and any one of a single-mode resonance cavity, a dual-mode resonance cavity and a triple-mode resonance cavity, resonance rods in the two resonance cavities are parallel, and the coupling is achieved through a size of a window between the two resonance cavities, the size of the window is determined according to coupling amounts; and the filter has function properties of band pass, band stop, high pass, low pass and a duplexer, a multiplexer and a combiner formed among the band pass, the band stop, the high pass and the low pass.

27. An irregular-shaped triple-mode cavity resonance structure, comprising a cavity and a cover plate, wherein the cavity is internally provided with a dielectric resonance block and a dielectric support frame, wherein the cavity is, of a cube-like shape, at least one end face of the cavity is convex, the dielectric resonance block is of a cube-like shape, at least one end face of the dielectric resonance block is concave, the dielectric support frame is respectively connected with the dielectric resonance block and an inner wall of the cavity, the dielectric resonance block and the dielectric support frame form a triple-mode dielectric resonance rod, and a dielectric constant of the dielectric support frame is smaller than a dielectric constant of the dielectric resonance block;

a ratio K of a size of a single side of the inner wall of the cavity to a size of a corresponding single side of the dielectric resonance block meets: transition point 1≤K≤transition point 2, a Q value of a higher-order mode, adjacent to a base mode, of the triple-mode dielectric resonance structure is transited into a Q value of the base mode of the triple-mode dielectric resonance structure, a base mode resonance frequency after transition is equal to a base mode resonance frequency prior to transition, a Q value of the base mode after transition is greater than a Q value of the base mode prior to transition, and a value of the higher-order mode, adjacent to the base mode, after transition is smaller than a Q value of the higher-order mode, adjacent to the base mode, prior to transition;

the triple-mode dielectric resonance structure is internally provided with a coupling structure for changing an orthogonal property of a degenerate triple-mode electromagnetic field in the cavity; and the triple-mode dielectric resonance structure is internally provided with a frequency tuning device for changing a resonance frequency of the degenerate triple-mode in the cavity.

28. The irregular-shaped triple-mode cavity resonance structure as claimed in claim 27, wherein a film medium is arranged on the convex end face of the cavity or/and the concave end face of the dielectric resonance block.

29. The irregular-shaped triple-mode cavity resonance structure as claimed in claim 27, wherein the dielectric resonance block is of a solid structure or a hollow structure; and a hollow part of the dielectric resonance block of the hollow structure is filled with air or a nested dielectric resonance block, and a volume of the nested dielectric resonance block is smaller than or equal to a volume of a hollow chamber.

30. The irregular-shaped triple-mode cavity resonance structure as claimed in claim 27, wherein a value of the transition point 1 and a value of the transition point 2 both vary according to different base mode resonance frequencies of the dielectric resonance block, the dielectric constant of the dielectric resonance block and the dielectric constant of the support frame.

31. The irregular-shaped triple-mode cavity resonance structure as claimed in claim 27, wherein when the base mode resonance frequency of the dielectric resonance block after transition remains unchanged, the Q value of the triple-mode dielectric resonance structure is related to the K value, the dielectric constant of the dielectric resonance block and the size of the dielectric resonance block.

32. The irregular-shaped triple-mode cavity resonance structure as claimed in claim 27, wherein when the K value is increased to a maximum from 1.0, the K value has three Q value transition points within a variation range, and each Q value transition point enables the Q value of the base mode of the K value and the Q value of the higher-order mode, adjacent to the base mode, of the K value to be transited; when the Q value of the base mode is lower than the Q value of the higher-order mode, adjacent to the base mode, the Q value of the higher-order mode, adjacent to the base mode, is transited into the Q value of the base mode, and the Q value of the base mode after transition is higher than the Q value of the base mode prior to transition; and when the Q value of the base mode is higher than the Q value of the higher-order mode, adjacent to the base mode, the Q value of the higher-order mode, adjacent to the base mode, is transited into the Q value of the base mode, and the Q value of the base mode after transition is lower than the Q value of the base mode prior to transition.

33. The irregular-shaped triple-mode cavity resonance structure as claimed in claim 27, wherein when the cavity and the dielectric resonance block have a same size in X, Y and Z axes, a degenerate triple mode is formed, and the degenerate triple mode is coupled with other single cavities to form a pass-band filter;

when differences of sizes of the cavity and the dielectric resonance block in three directions, along the X, Y and Z axes, are slightly unequal, orthogonal-like triple-mode resonance is formed, if the orthogonal-like triple-mode is capable of coupling with other cavities into a pass-band filter, the sizes are acceptable, and if the orthogonal-like triple-mode is not capable of coupling with other cavities into the pass-band filter, the sizes are unacceptable; and when the differences of the sizes of the cavity and the dielectric resonance block in the three directions along the X, Y and Z axes are greatly different, the degenerate triple-mode or the orthogonal-like triple-mode can not be formed, three modes of different frequencies are formed instead, thus the modes can not be coupled with other cavities into the pass-band filter, and the sizes are unacceptable.

34. The irregular-shaped triple-mode cavity resonance structure as claimed in claim 27, wherein the triple-mode dielectric resonance structure is internally provided with at least two non-parallel arranged coupling devices for changing the orthogonal property of the degenerate triple-mode electromagnetic field in the cavity, each coupling device comprises cut corners/chamfers/grooves disposed on edges of the dielectric resonance block, or comprises chamfers/cut corners disposed at inner corners of the cavity, or comprises cut corners/chamfers/grooves disposed beside edges of the dielectric resonance block and chamfers/cut corners disposed beside edges of the cavity, or comprises tapping lines or/pieces arranged on non-parallel planes in the cavity;

the cut corners are of a triangular-prism shape, a cuboid shape or a sector shape; after corner cutting, in case of frequency holding, side lengths of the dielectric resonance block are increased, and the Q value is slightly decreased;

depths of the cut corners or holes are of through or partial cut corners/partial hole structures according to the required coupling amounts;

the coupling amounts are affected by sizes of the cut corners/chamfers/holes;

the coupling tuning structure comprises a coupling screw disposed in a direction perpendicular or parallel to the cut corners, the coupling screw is made of a metal, or the coupling screw is made of a metal and the metal surface is electroplated by copper or electroplated by silver, or the coupling screw is made of a medium, or the coupling screw is made of a surface metalized medium; and the shape of the coupling screw is any one of metallic rods, medium rods, metallic discs, medium discs, metallic rods with metallic discs, metallic rods with medium discs, medium discs with metallic discs and medium rods with medium discs.

35. The irregular-shaped triple-mode cavity resonance structure as claimed in claim 27, wherein the triple-mode dielectric resonance structure is internally provided with at least two non-parallel arranged coupling devices for changing the orthogonal properties of a degenerate triple-mode electromagnetic field in the cavity, each coupling device comprises holes/grooves arranged on an end face of the dielectric resonance block, center lines of the holes or grooves are parallel to edges perpendicular to the end faces with holes or grooves of the dielectric resonance block;

or comprises a chamfers/cut corners arranged at an inner corners of the cavity, or comprises holes/grooves arranged in the end faces of the dielectric resonance block and chamfers/cut corners arranged beside edges of the cavity, or comprises tapping lines or/pieces arranged on a non-parallel planes in the cavity;

depths of the holes are of through hole structures or partial hole structures according to required coupling amounts;

the coupling amounts are affected by the sizes of the holes;

the holes/grooves are of a circular shape, a rectangular shape or a polygonal shape, and after the holes/grooves are formed, in case of frequency holding, side lengths of the dielectric resonance block are increased, and the Q value is slightly decreased;

the coupling tuning structure comprises a coupling screw disposed in a direction parallel to the holes, the coupling screw is made of a metal, or the coupling screw is made of a metal and the metal surface is electroplated by copper or electroplated by silver, or the coupling screw is made of a medium, or the coupling screw is made of a surface metallized medium; and the shape of the coupling screw is any one of metallic rods, medium rods, metallic discs, medium discs, metallic rods with metallic discs, metallic rods with medium discs, medium discs with metallic discs and medium rods with medium discs.

36. The irregular-shaped triple-mode cavity resonance structure as claimed in claim 27, wherein the cavity is of a cube-like shape, to achieve coupling of three modes, on premise that the size of the dielectric resonance block is not changed, cut sides for achieving coupling of the three modes are processed on any two adjacent faces of the cavity, sizes of the cut sides are relevant to required coupling amounts; a coupling of two of the three modes is achieved through the cut sides of the cavity, and other coupling is achieved through cut corners of two adjacent sides of the cavity, walls are not broken when corners of the adjacent sides of the cavity are cut, and corner-cut faces need to be completely sealed with the cavity; a surface of the cavity is electroplated by copper or electroplated by silver, and the cavity is made of a metal or a non-metal material; and when the cavity is made of the non-metal material, the inner wall of the cavity is electroplated by a conductive material.

37. The irregular-shaped triple-mode cavity resonance structure as claimed in claim 27, wherein when the cavity is of the cube-like shape, the dielectric resonance block and the dielectric support frame are installed in any one axial direction of the cavity, and a center of the dielectric resonance block coincides with or approaches to a center of the cavity.

38. The irregular-shaped triple-mode cavity resonance structure as claimed in claim 27, wherein the dielectric constant of the dielectric support frame is similar to an air dielectric constant, and the dielectric support frame has no influence on the resonance frequency of the triple-mode; and the dielectric support frame supports with any one single face of the dielectric resonance block, or supports with six faces, or supports with different combinations of different two faces, three faces, four faces and five faces, a number of the dielectric support frame on each face is one or more; and one or more support frames is installed on different faces according to demands.

39. The irregular-shaped triple-mode cavity resonance structure as claimed in claim 27, wherein the dielectric constant of the dielectric support frame is greater than an air dielectric constant and smaller than the dielectric constant of the dielectric resonance block; to hold original triple-mode frequencies, a size, corresponding to an axial direction, of the dielectric resonance block of the dielectric support frame is slightly reduced; the dielectric support frame supports with any one single face of the dielectric resonance block, or supports with six faces, or supports with different combinations of two different faces, three faces, four faces and five faces, a face without the support frame is an air face, the air face is arbitrarily combined with the dielectric support frame; a number of the dielectric support frame on each face is one or more, or the dielectric support frame on each face is a complex dielectric constant support frame composed of multiple layers of different dielectric constant medium materials, single-layer and multi-layer medium material support frames are arbitrarily combined with a cube-like medium block, one or more dielectric support frames is installed on different faces according to demands, on faces with the dielectric support frames, to hold the triple-mode frequencies and the Q value, the size, corresponding to the axial direction of the dielectric resonance block, of the dielectric support frame is slightly decreased.

40. The irregular-shaped triple-mode cavity resonance structure as claimed in claim 27, wherein a surface area of the dielectric support frame is smaller than or equal to a surface area of the dielectric resonance block; the dielectric support frame is of a cylinder shape, a cube shape or a cuboid shape;

the dielectric support frame is of a solid structure or a hollow structure, and the dielectric support frame of the hollow structure has a single hole or multiple holes, each hole takes a shape of a circle, a square, a polygon and an arc; and the dielectric support frame is made of air, plastics, ceramics or mediums.

41. The irregular-shaped triple-mode cavity resonance structure as claimed in claim 27, wherein the dielectric support frame and the dielectric resonance block are connected in a mode of crimping, adhesion or sintering; and the dielectric support frame and the inner wall of the cavity are connected in a mode of adhesion, crimping, welding, sintering or screw fixation.

42. The irregular-shaped triple-mode cavity resonance structure as claimed in claim 27, wherein a radio frequency channel formed by coupling of radio frequency signals in directions of X, Y and Z axes of the triple mode causes loss and generates heat, the dielectric resonance block is sufficiently connected with the inner wall of the cavity through the dielectric support frame, and thus the heat is conducted into the cavity for heat dissipation.

43. The irregular-shaped triple-mode cavity resonance structure as claimed in claim 27, wherein a frequency temperature coefficient of the dielectric resonance block is controlled by adjusting proportions of medium materials, and is compensated according to frequency deviation variation of a filter at different temperatures.

44. A filter having a irregular-shaped triple-mode cavity resonance structure, comprising a cavity, a cover plate and an input/output structure, wherein the cavity is internally provided with at least one irregular-shaped triple-mode cavity resonance structure as claimed in claim 27;

the irregular-shaped triple-mode cavity resonance structure is combined with a single-mode resonance structure, a dual-mode resonance structure and a triple-mode resonance structure in different modes to form filters of different volumes;

a coupling of any two resonance cavities formed by permutation and combination by the irregular-shaped triple-mode cavity resonance structure and any one of a single-mode resonance cavity, a dual-mode resonance cavity and a triple-mode resonance cavity, resonance rods in the two resonance cavities are parallel, and the coupling is achieved through a size of a window between the two resonance cavities, the size of the window is determined according to coupling amounts; and the filter has function properties of band pass, band stop, high pass, low pass and a duplexer, a multiplexer and a combiner formed among the band pass, the band stop, the high pass and the low pass.

* * * * *